US011283222B2

(12) United States Patent
Trout et al.

(10) Patent No.: US 11,283,222 B2
(45) Date of Patent: Mar. 22, 2022

(54) CONTACT MODULE FOR A HEADER ASSEMBLY

(71) Applicant: TE Connectivity Services GmbH, Schaffhausen (CH)

(72) Inventors: David Allison Trout, Lancaster, PA (US); Douglas Edward Shirk, Elizabethtown, PA (US); Jeffrey Byron McClinton, Harrisburg, PA (US); Wei Peng, Mechanicsburg, PA (US); Justin Dennis Pickel, Hummelstown, PA (US); Timothy Robert Minnick, Enola, PA (US); Edward Lee Hengst, Glen Rock, PA (US); Karen Elizabeth Benjamin, Hershey, PA (US)

(73) Assignee: TE CONNECTIVITY SERVICES GmbH, Schaffhausen (CH)

( * ) Notice: Subject to any disclaimer, the term of this patent is extended or adjusted under 35 U.S.C. 154(b) by 0 days.

(21) Appl. No.: 16/997,068

(22) Filed: Aug. 19, 2020

(65) Prior Publication Data

US 2022/0059974 A1 Feb. 24, 2022

(51) Int. Cl.

| | |
|---|---|
| ***H01R 13/648*** | (2006.01) |
| ***H01R 13/6587*** | (2011.01) |
| ***H01R 12/72*** | (2011.01) |
| ***H01R 13/6471*** | (2011.01) |
| ***H01R 13/04*** | (2006.01) |
| ***H01R 13/518*** | (2006.01) |

(52) U.S. Cl.
CPC ..... *H01R 13/6587* (2013.01); *H01R 12/724* (2013.01); *H01R 13/04* (2013.01); *H01R 13/518* (2013.01); *H01R 13/6471* (2013.01)

(58) Field of Classification Search
CPC ..... H01R 13/6587; H01R 13/6471; H01R 13/518; H01R 13/04
USPC ..... 439/79, 607.09
See application file for complete search history.

(56) References Cited

U.S. PATENT DOCUMENTS

| | | | | |
|---|---|---|---|---|
| 8,888,530 | B2 | 11/2014 | Trout et al. | |
| 8,992,252 | B2 | 3/2015 | McClellan et al. | |
| 10,096,924 | B2 | 10/2018 | Trout et al. | |
| 10,476,210 | B1 | 11/2019 | Trout et al. | |
| 10,811,801 | B2 * | 10/2020 | Pickel | H01R 13/03 |
| 11,018,457 | B2 * | 5/2021 | Pickel | H01R 13/646 |

* cited by examiner

*Primary Examiner* — Khiem M Nguyen

(57) ABSTRACT

A header assembly includes a header housing and contact modules coupled to the header housing each having a frame assembly with a signal leadframe and a dielectric frame. The dielectric frame includes mating portion extensions at a front of the dielectric frame. The signal leadframe includes mating portions extending forward from the mating portion extensions. Each contact module includes a ground shield having ground shrouds providing electrical shielding for the mating portions. Each ground shroud includes shroud walls forming a shroud cavity receiving the corresponding mating portion extension. Each ground shroud includes a shroud transition to vary a depth of the shroud cavity along a length of the ground shroud.

21 Claims, 14 Drawing Sheets

CONTACT MODULE FOR A HEADER ASSEMBLY

BACKGROUND OF THE INVENTION

The subject matter herein relates generally to connector assemblies.

Some electrical systems utilize connector assemblies, such as header assemblies and receptacle assemblies, to interconnect two circuit boards, such as a motherboard and daughtercard. Typically, a midplane assembly is provided between the mother board and the daughtercard. For example, the midplane assembly includes a midplane circuit board having header assemblies mounted to opposite sides of the midplane circuit board. The motherboard and the daughtercard each include a receptacle assembly, which are mated to the corresponding header assemblies. Such electrical systems suffer from signal degradation across the multiple interfaces through the midplane assembly and receptacle connectors. The receptacle assemblies include contact modules having contacts terminated to the circuit boards. The header assemblies include contacts terminated to the midplane circuit board.

Furthermore, high speed connector assemblies suffer from problems with cross talk and can exhibit higher than desirable insertion loss due to geometries of the signal contacts and the shield structure for the connector assemblies. For example, gaps or spaces in shielding through the connector assembly can result in reduced connector performance. Additionally, contact modules have problems with electrical skew due to contacts having different lengths. Some known connector assemblies provide conductive holders for each contact module that provides 360° shielding for each pair of signal contacts along the entire lengths of the signal transmission lines. For example, the contact modules include plated plastic shells that hold each leadframe. However, the plated plastic shells are expensive to manufacture.

A need remains for cost effective and reliable connector assemblies having improved electrical performance.

BRIEF DESCRIPTION OF THE INVENTION

In one embodiment, a header assembly is provided. The header assembly includes a header housing having a header chamber configured to receive a receptacle assembly. The header assembly includes contact modules coupled to the header housing. Each contact module includes a frame assembly having a signal leadframe and a dielectric frame holding the signal leadframe. The dielectric frame includes mating portion extensions at a front of the dielectric frame. The signal leadframe includes mating portions extending forward from the mating portion extensions for mating with the receptacle assembly. Each contact module includes a ground shield coupled to a first side of the dielectric frame. The ground shield includes ground shrouds at a front of the ground shield providing electrical shielding for the mating portions of the signal leadframe. Each ground shroud includes shroud walls forming a shroud cavity receiving the corresponding mating portion extension. Each ground shroud includes a shroud transition to vary a depth of the shroud cavity along a length of the ground shroud.

In another embodiment, a header assembly is provided. The header assembly includes a header housing having a header chamber configured to receive a receptacle assembly. The header assembly includes contact modules coupled to the header housing. Each contact module includes a frame assembly having a signal leadframe and a dielectric frame holding the signal leadframe. The signal leadframe includes signal contacts including mating portions extending forward from the dielectric frame for mating with the receptacle assembly. The signal leadframe has a front section and a rear section. The front section has a first material thickness. The rear section has a second material thickness thinner than the first material thickness. The front section includes the mating portions. Each contact module includes a ground shield coupled to a first side of the dielectric frame. The ground shield includes ground shrouds at a front of the ground shield providing electrical shielding for the mating portions of the signal leadframe.

In a further embodiment, a header assembly is provided. The header assembly includes a header housing having a header chamber configured to receive a receptacle assembly. The header assembly includes contact modules coupled to the header housing. Each contact module includes a frame assembly having a signal leadframe and a dielectric frame holding the signal leadframe. The signal leadframe includes mating portions extending forward from the dielectric frame for mating with the receptacle assembly. Each contact module includes a mating ground shield coupled to a first side of the dielectric frame and a connecting ground shield. The mating ground shield includes ground shrouds at a front of the mating ground shield providing electrical shielding for the mating portions of the signal leadframe. Each mating ground shroud includes shroud walls forming a shroud cavity receiving the corresponding mating portions. The mating ground shroud including connecting tabs engaging the connecting ground shield to electrically connect the mating ground shield and the connecting ground shield.

DETAILED DESCRIPTION OF THE INVENTION

Figure 1:
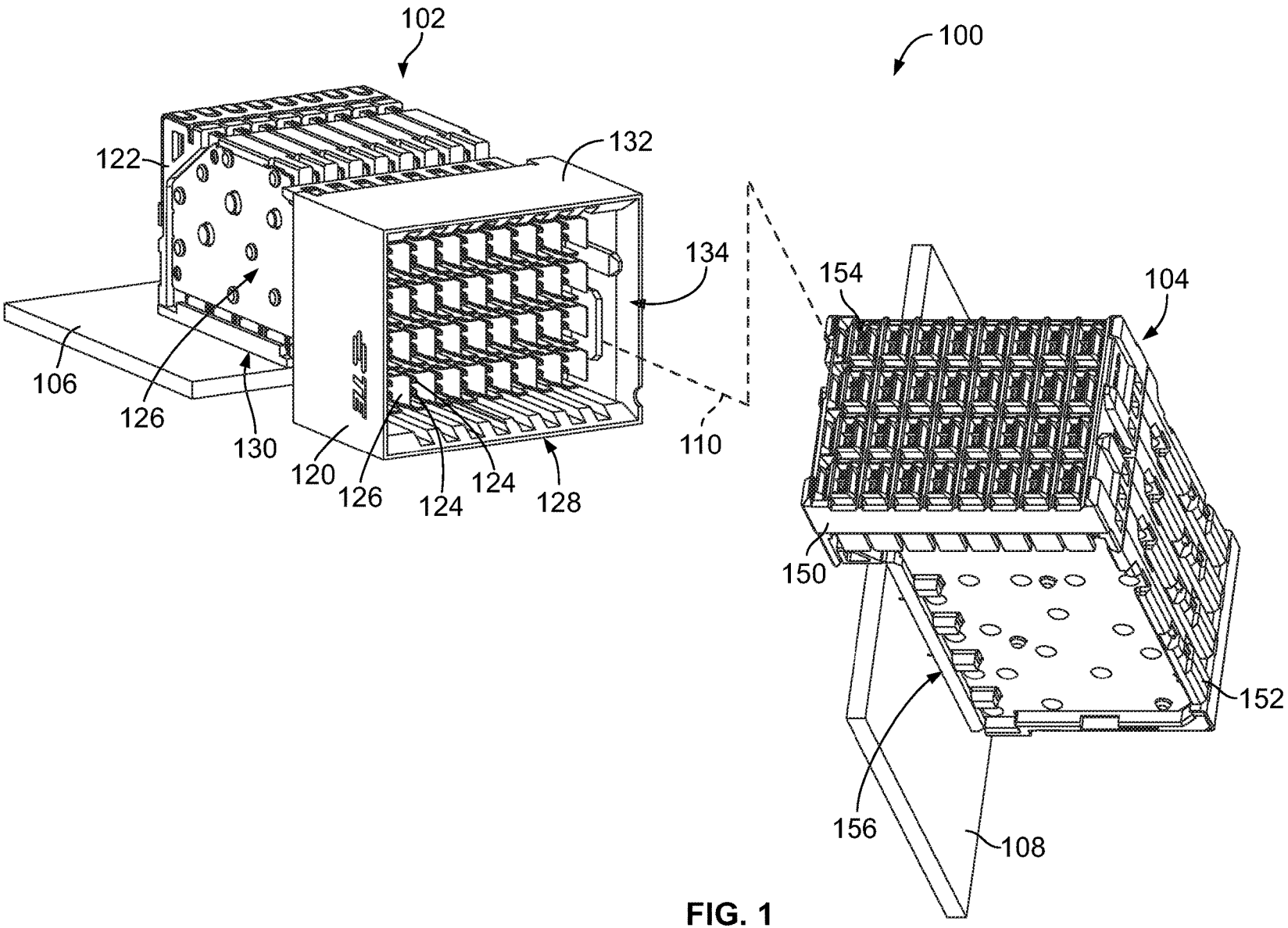
FIG. 1 is a perspective view of an electrical connector system in accordance with an exemplary embodiment.

FIG. 1 is a perspective view of an exemplary embodiment of an electrical connector system 100 illustrating a first connector assembly 102 and a second connector assembly 104 that may be directly mated together. The first connector assembly 102 and/or the second connector assembly 104 may be referred to hereinafter individually as a "connector assembly" or collectively as "connector assemblies". The first connector assembly 102 or the second connector assembly 104 may be a receptacle assembly and the first connector assembly 102 or the second connector assembly 104 may be a header assembly. In the description, the first connector assembly 102 and corresponding components may be referred to as a header assembly 102 and corresponding header components and the second connector assembly 104 and corresponding components may be referred to as a receptacle assembly 104 and corresponding receptacle components.

The first and second connector assemblies 102, 104 are each electrically connected to respective circuit boards 106, 108. The first and second connector assemblies 102, 104 are utilized to electrically connect the circuit boards 106, 108 to one another at a separable mating interface. The first and second connector assemblies 102, 104 allow direct connection of the first and second circuit boards 106, 108 without the need for a midplane circuit board therebetween. For example, the first circuit board 106 has the header assembly 102 mounted thereto and the second circuit board 108 has the receptacle assembly 104 mounted thereto which is directly pluggable into the header assembly 102. In an exemplary embodiment, the circuit boards 106, 108 are oriented perpendicular to one another when the first and second connector assemblies 102, 104 are mated. Alternative orientations of the circuit boards 106, 108 are possible in alternative embodiments. A mating axis extends through the first and second connector assemblies 102, 104. The first and second connector assemblies 102, 104 are mated together in a direction parallel to and along the mating axis.

The header assembly 102 includes a header housing 120 that holds a plurality of contact modules 122. Any number of contact modules 122 may be provided to increase the signal pin count of the header assembly 102. The contact modules 122 each include a plurality of signal contacts 124 that are received in the header housing 120 for mating with the receptacle assembly 104. In an exemplary embodiment, the signal contacts 124 are arranged in pairs defining differential pairs. In the illustrated embodiment, the pairs of signal contacts 124 are arranged in columns defining a pair-in-column connector interface. In an exemplary embodiment, each contact module 122 has a shield structure 126 for providing electrical shielding for the signal contacts 124. In an exemplary embodiment, the shield structure 126 is electrically connected to the receptacle assembly 104 and/or the circuit board 106. For example, the shield structure 126 may be electrically connected to the circuit board 106 by features, such as ground pins. The shield structure 126 may be electrically connected to the receptacle assembly 104 by extensions extending from the contact modules 122 that engage the receptacle assembly 104. For example, the shield structure 126 includes ground shields and orphan ground shields 127 (orphan ground shields 127 close the open side of the C-shaped ground shields).

The header assembly 102 includes a mating end 128 and a mounting end 130. The signal contacts 124 are received in the header housing 120 and held therein at the mating end 128, such as for mating to the receptacle assembly 104. In other embodiments, the mating end 128 may be mated to another component, such as a circuit board. The signal contacts 124 are arranged in a matrix of rows and columns. In the illustrated embodiment, at the mating end 128, the rows are oriented horizontally and the columns are oriented vertically. Other orientations are possible in alternative embodiments. Any number of signal contacts 124 may be provided in the rows and columns. The signal contacts 124 also extend to the mounting end 130 for mounting to an electrical component, such as the circuit board 106. In other embodiments, the mounting end 130 may be mounted to another electrical component, such as an electrical connector. Optionally, the mounting end 130 may be substantially perpendicular to the mating end 128.

The header housing 120 includes housing walls 132 forming a header chamber 134. The header chamber 134 receives the receptacle assembly 104. The signal contacts 124 extend into the header chamber 134 for mating with the receptacle assembly 104. In the illustrated embodiment, the header chamber 134 is rectangular shaped. For example, four housing walls 132 form the rectangular header chamber 134. The header housing 120 is manufactured from a dielectric material, such as a plastic material.

The receptacle assembly 104 includes a receptacle housing 150 holding contact modules 152. The receptacle assembly 104 has a mating end 154 and a mounting end 156 mounted to the circuit board 108. Optionally, the mounting end 156 may be substantially perpendicular to the mating end 154. The mating end 154 is received in the header chamber 134. The receptacle housing 150 may include locating features, such as keying features, to guide mating with the header housing 120. The receptacle assembly 104 includes a shield structure, such as ground shields on the contact modules 152.

Figure 2:
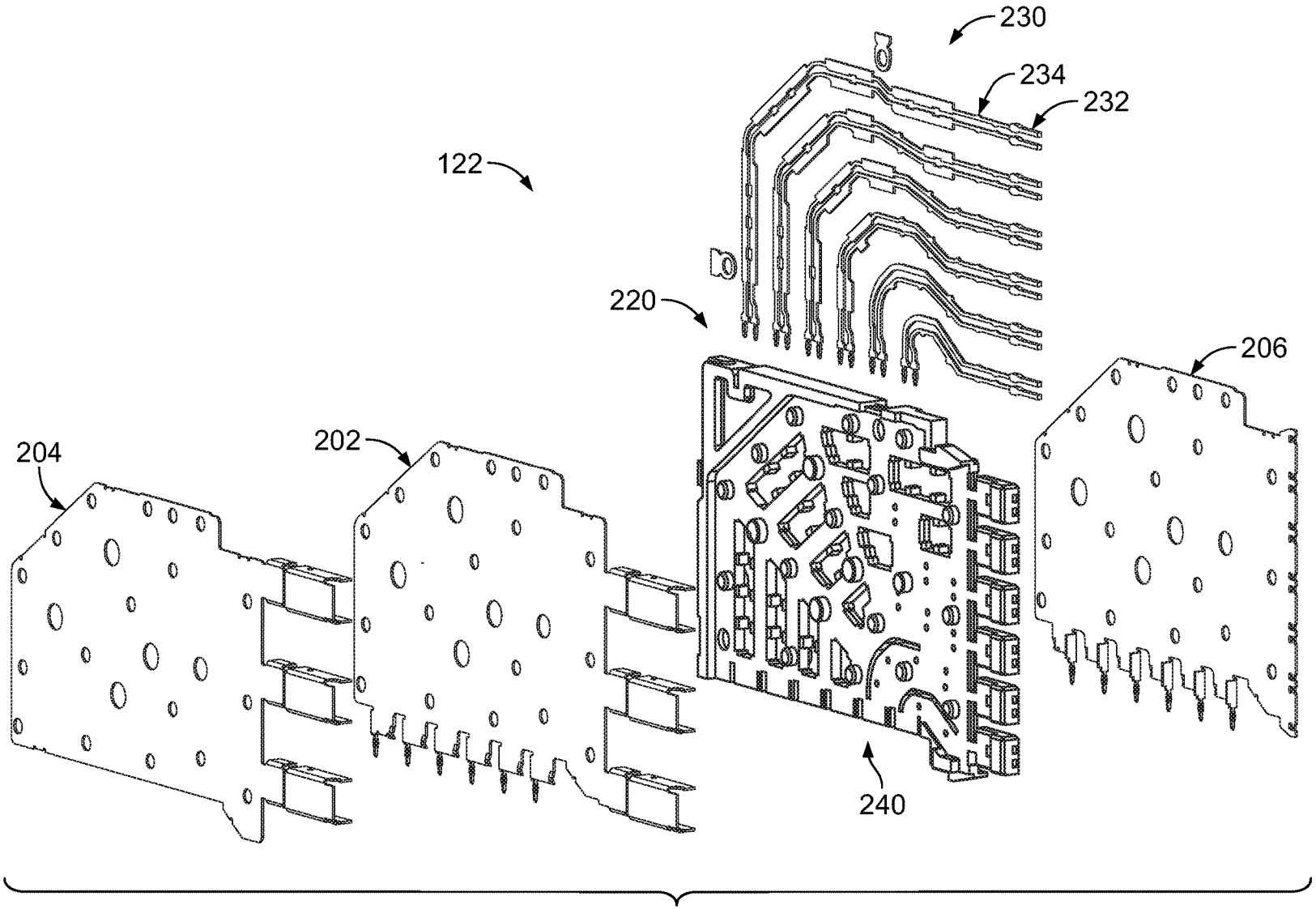
FIG. 2 is an exploded view of a contact module in accordance with an exemplary embodiment.

FIG. 2 is an exploded view of one of the contact modules 122 and part of the shield structure 126. The shield structure 126 includes a first mating ground shield 202 and a second mating ground shield 204. The shield structure 126 may include a connecting ground shield 206 on the opposite side from the first and second mating ground shields 202, 204. The first and the second ground shields 202, 204 electrically connect the contact module 122 to the shield structure of the receptacle assembly 104 (shown in FIG. 1). The mating ground shields 202, 204 and the connecting ground shield 206 provide electrical shielding on both sides of the signal contacts 124. In an exemplary embodiment, the mating ground shields 202, 204 and the connecting ground shield 206 are configured to be closely coupled to the signal contacts 124 to provide electrical shielding between pairs of the signal contacts 124 without being physically located between the pairs of signal contacts 124. The mating ground shields 202, 204 are provided at a first side of the contact module 122 and the connecting ground shield 206 is provided at a second side of the contact module 122.

The contact module 122 includes a frame assembly 220 including a leadframe 230 and a dielectric frame 240. The leadframe 230 defines the signal contacts 124. The leadframe 230 is a stamped and formed structure. For example, the leadframe 230 is stamped from a metal sheet. The dielectric frame 240 surrounds and supports the signal contacts 124 of the leadframe 230. For example, the dielectric frame 240 may be an overmolded body configured to be overmolded around the leadframe 230 to form the dielectric frame 240. Other manufacturing processes may be utilized to form the contact modules 122, such as loading signal contacts 124 into a formed dielectric body. The signal contacts 124 are shaped and positioned for enhanced electrical performance at high data speed, such as to reduce cross-talk, reduce insertion loss, reduce skew, match target impedance, and the like. The dielectric frame 240 is positioned relative to the leadframe 230 for enhanced electrical performance at high data speeds, such as to reduce cross-talk, reduce insertion loss, reduce effects of skew, achieve target impedance, and the like.

In an exemplary embodiment, the leadframe 230 includes a front section 232 and a rear section 234. The front section 232 defines a mating end of the leadframe 230 configured to be mated with the receptacle assembly 104. For example, the front section 232 includes mating pins of the signal contacts 124. The rear section 234 defines a mounting end of the leadframe 230 configured to be mounted to the circuit board 106. For example, the rear section 234 includes mounting pins of the signal contacts 124. The leads forming the signal contacts 124 transition between the mating pins and the mounting pins. The leads may form part of the rear section 234 and/or the front section 232. However, in various embodiments, the front section 232 only includes the mating pins and the rear section 234 includes the transition portions of the leads and the mounting pins.

In an exemplary embodiment, the front section 232 and the rear section 234 are stamped from the same metal sheet, which has a sheet thickness. In an exemplary embodiment, the rear section 234 is milled to remove and thin out part of the leadframe 230. For example, the transition portions of the leads and the mounting pins are made thinner than the mating pins by the milling process. For example, the mating pins at the front section 232 may have a first thickness and the transition portions of the leads and the mounting pins at the rear section 234 may have a second thickness thinner than the first thickness. The mating pins may remain thicker for mating with the receptacle assembly. The transition portions of the leads and the mounting pins may be made thinner for improved electrical characteristics, such as to improve signal integrity.

Figure 3:
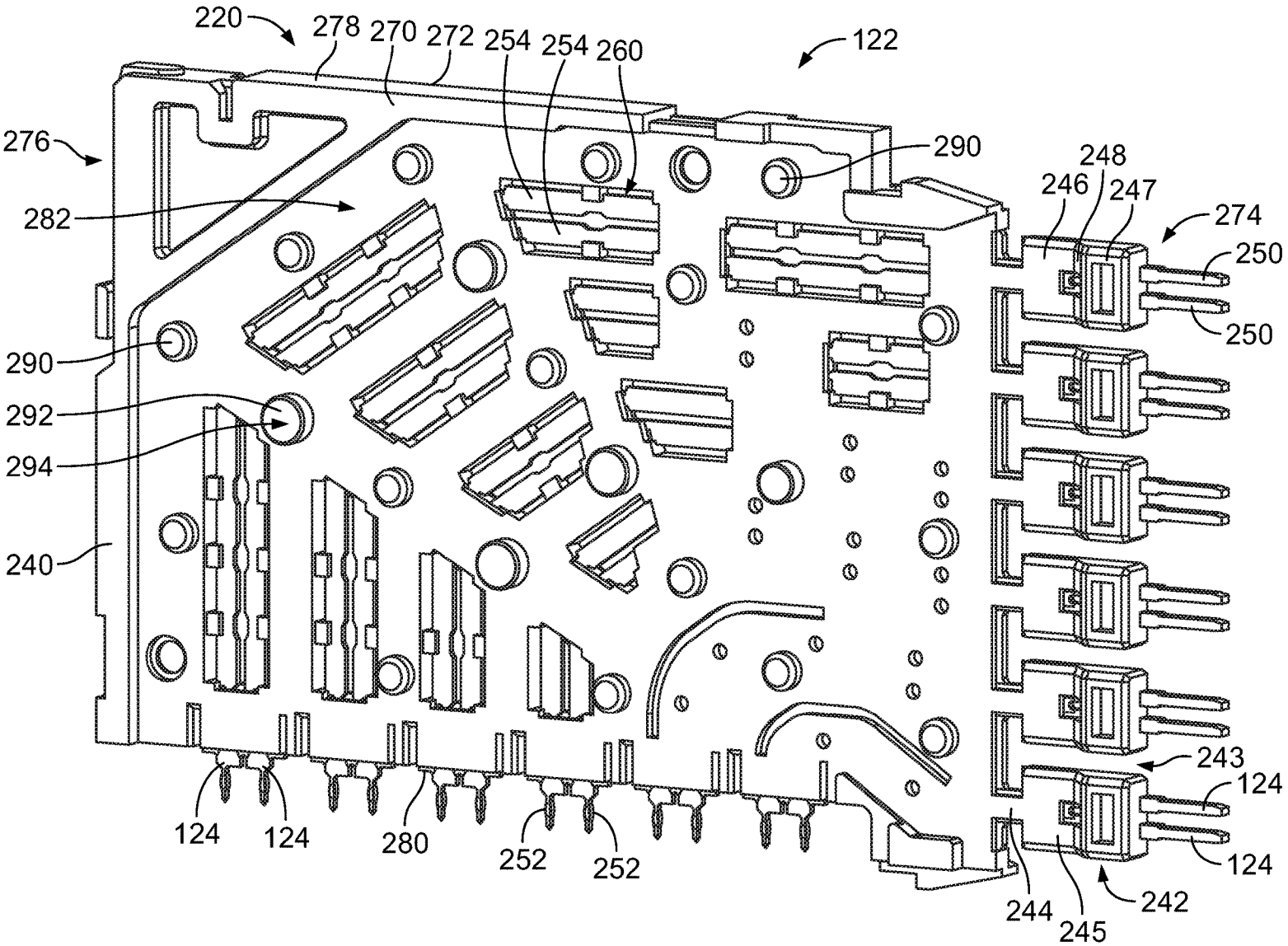
FIG. 3 is a perspective view of a first side of a portion of the contact module in accordance with an exemplary embodiment.

FIG. 3 is a perspective view of the first side of a portion of the contact module 122 in accordance with an exemplary embodiment. FIG. 3 illustrates the frame assembly 220 with the ground shields 202, 204, 206 (shown in FIG. 2) removed for clarity to illustrate the dielectric frame 240. The dielectric frame 240 includes frame members holding the signal contacts 124. In an exemplary embodiment, the frame members encase portions or segments of the signal contacts 124 and the dielectric frame 240 includes openings or windows 260 that expose portions or segments of the signal contacts 124.

The signal contacts 124 have mating portions 250 extending forward from a front of the dielectric frame 240 and mounting portions 252 extending from a bottom of the dielectric frame 240. The signal contacts 124 include leads 254 extending between the mating portions 250 and the mounting portions 252. The leads 254 extend along generally parallel paths or segments that transition through the frame assembly 220 between the mating portions 250 and the mounting portions 252 (for example, the leads 254 transition through generally right-angle paths between the front and the bottom). The mating portions 250 extend from the dielectric frame 240 for mating with the receptacle assembly 104 (shown in FIG. 1). The mounting portions 252 extend from the dielectric frame 240 for mounting to the circuit board 106 (shown in FIG. 1). In the illustrated embodiment, the mounting portions 252 are compliant pins, such as eye-of-the-needle pins. Other types of mounting portions 252 may be provided in alternative embodiments, such as solder tails, spring beams, and the like. In an exemplary embodiment, the mating portions 250 extend generally perpendicular with respect to the mounting portions 252. In the illustrated embodiment, the mating portions 250 are pins. Other types of mating portions 250 may be provided in alternative embodiments, such as sockets.

In an exemplary embodiment, the windows 260 extend entirely through the dielectric frame 240. The windows 260 extend along portions or segments of the leads 254 between the mating portions 250 and the mounting portions 252. In an exemplary embodiment, the windows 260 extend along a majority of the length of the corresponding leads 254. In an exemplary embodiment, the windows 260 have different lengths. The number and lengths of the windows 260 provide electrical compensation for the signal transmission lines, such as to reduce cross-talk, reduce insertion loss, reduce skew, match target impedance, and the like.

In an exemplary embodiment, the dielectric frame 240 includes a first side 270 and a second side 272 opposite the first side 270. The dielectric frame 240 includes a front 274 and a rear 276 opposite the front 274. The dielectric frame 240 includes a top 278 and a bottom 280 opposite the top 278. The mating ground shields 202, 204 (FIG. 2) are configured to be coupled to the first side 270 and the connecting ground shield 206 (FIG. 2) is configured to be coupled to the second side 272. In an exemplary embodiment, the dielectric frame 240 includes a first pocket 282 at the first side 270 that receives the mating ground shields 202, 204.

In an exemplary embodiment, the dielectric frame 240 includes securing posts 290 extending into the first pocket 282. The securing posts 290 secure the mating ground shields 202 and 204 to the dielectric frame 240. In various embodiments, the securing posts 290 may be heat stakes. In an exemplary embodiment, the securing posts 290 are shaped to pull the mating ground shields 202, 204 inward into the first pocket 282 against the dielectric frame 240. In an exemplary embodiment, the dielectric frame 240 includes locating posts 292 extending into the first pocket 282 to distal ends 294. The distal ends 294 are configured to engage the locating posts of an adjacent contact module 122 to locate the contact module 122 relative to the adjacent contact module 122. For example, the distal ends 284 may butt up against the locating posts of the adjacent contact module 122 to support and/or control spacing of the contact modules 122 relative to each other.

In an exemplary embodiment, the dielectric frame 240 includes mating portion extensions 242 extending from a front edge of the dielectric frame 240 at the front 274. The mating portion extensions 242 are dielectric bodies that surround and support the mating portions 250 of the signal contacts 124. For example, each mating portion extension 242 may support a pair of the signal contacts 124. In an exemplary embodiment, the mating portion extensions 242 are separated from each other by gaps 243. Each mating portion extension 242 includes a neck 244 and a head 245 forward of the neck 244. The head 245 is wider than the neck 244. Optionally, the neck 244 may be approximately centered relative to the head 245 and connects the front 274 of the dielectric frame to the head 245. In various embodiments, upper and lower edges of the head 245 may be planar and parallel to each other. Optionally, one or both of the sides of the head 245 may be nonplanar. For example, the head 245 may have a variable width along the mating portion extension 242. In the illustrated embodiment, the first side is non-planar while the second side is planar.

In an exemplary embodiment, the head 245 of each mating portion extension 242 includes an inner extension 246 and an outer extension 247. The inner extension 246 is located between the neck 244 and the outer extension 247. The outer extension 247 is located forward of the inner extension 246. In an exemplary embodiment, a transition ramp 248 extends between the inner extension 246 and the outer extension 247. The inner extension 246 is narrower than the outer extension 247. The outer extension 247 has a greater width than the inner extension 246. The transition ramp 248 transitions between the narrower inner extension 246 and the wider outer extension 247. The width of the mating portion extension 242 is used to control a spacing between the shield structure in the mating portions 250. The amount of plastic material between the shield structure in the mating portions 250 affects signal characteristics of the mating portions 250, such as the impedance.

In an exemplary embodiment, the mating portion extension 242 includes an impedance control pocket 249 to control the impedance of the mating portions 250. For example, the impedance control pocket 249 introduces air between the shield structure and the mating portions 250 to control the impedance.

Figure 4:
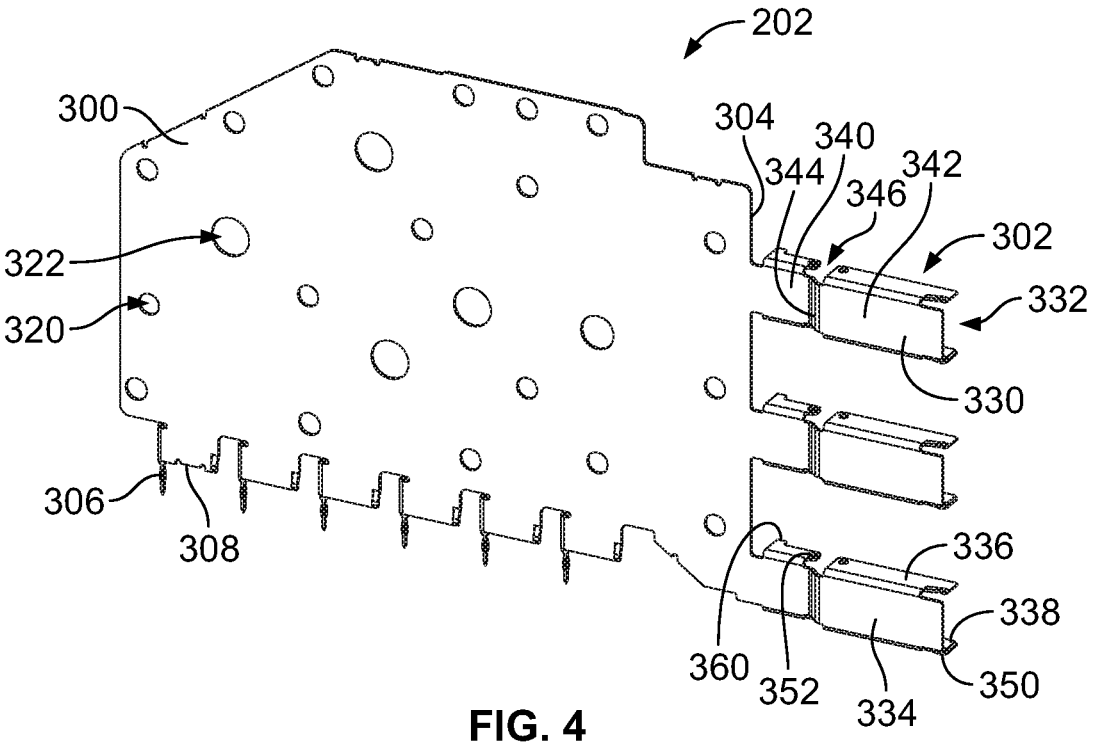
FIG. 4 is a perspective view of a first mating ground shield of the contact module in accordance with an exemplary embodiment.
Figure 5:
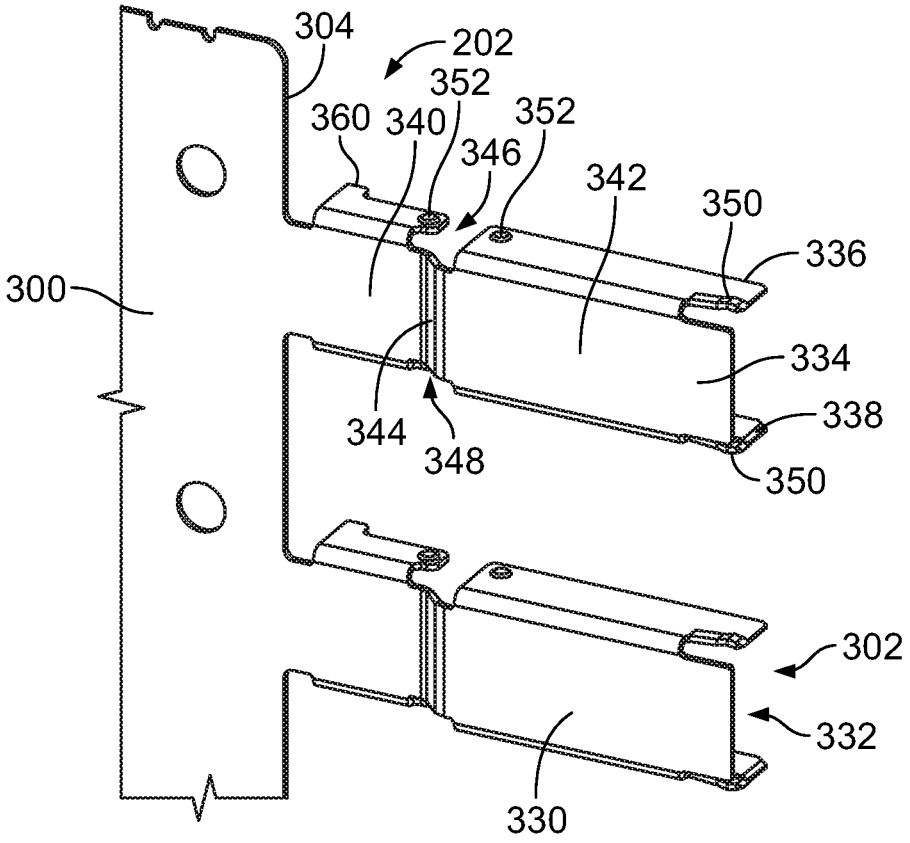
FIG. 5 is an enlarged perspective view of a portion of the first mating ground shield in accordance with an exemplary embodiment.

FIG. 4 is a perspective view of the first mating ground shield 202 in accordance with an exemplary embodiment. FIG. 5 is an enlarged perspective view of a portion of the first mating ground shield 202 in accordance with an exemplary embodiment. The first mating ground shield 202 includes a main body 300. In the illustrated embodiment, the main body 300 is generally planar. In an exemplary embodiment, the first mating ground shield 202 is manufactured from a metal material. For example, the metal material may be phosphor-bronze, brass, copper, silver, aluminum, platinum and the like or a combination thereof. In an exemplary embodiment, the first mating ground shield 202 may be stamped and formed.

The first mating ground shield 202 includes ground shrouds 302 extending forward from a front 304 of the main body 300. The ground shrouds 302 are configured to provide electrical shielding for the mating portions 250 (shown in FIG. 3) of the signal contacts 124 (shown in FIG. 3). The first mating ground shield 202 includes a plurality of ground pins 306 extending from a bottom 308 of the first mating ground shield 202. The ground pins 306 are configured to be terminated to the circuit board 106 (shown in FIG. 1). The ground pins 306 may be compliant pins, such as eye-of-the-needle pins, that are press-fit into plated vias in the circuit board 106. Other types of termination means or features may be provided in alternative embodiments to couple the first mating ground shield 202 to the circuit board 106.

In an exemplary embodiment, the first mating ground shield 202 includes securing post openings 320 configured to receive corresponding securing posts 290 at the first side 270 of the dielectric frame 240 (shown in FIG. 3). The securing posts 290 extend through the securing post openings 320 and are configured to be secured to the first mating ground shield 202. Optionally, the securing posts 290 may be heat staked or riveted to the first mating ground shield 202 to secure the first mating ground shield 202 to the dielectric frame 240. In various embodiments, the securing posts 290 may be coupled to the first mating ground shield 202 by ultrasonic welding. In an exemplary embodiment, the first mating ground shield 202 includes locating post openings 322 configured to receive corresponding locating posts 292 (shown in FIG. 3).

The ground shrouds 302 extend forward from the front edge of the main body 300 at the front 304. Each ground shroud 302 includes shroud walls 330 forming a shroud cavity 332. The shroud cavity 332 is sized and shaped to receive the corresponding mating portion extension 242 (shown in FIG. 3) and the mating portions 250 of the signal contacts 124. The shroud walls 330 provide electrical shielding for the mating portions 250 in the shroud cavity 332.

In an exemplary embodiment, the shroud walls 330 form a C-shaped ground shroud 302. The ground shroud 302 may have other shapes in alternative embodiments. In the illustrated embodiment, the shroud walls 330 include a center wall 334, a first end wall 336, and a second end wall 338. The first end wall 336 extends from the top edge of the center wall 334 and the second end wall 338 extends from the bottom edge of the center wall 334. In various embodiments, the first end wall 336 may extend generally parallel to the second end wall 338. In an exemplary embodiment, the first and second end walls 336, 338 are formed by folding or bending the end wall 336, 338 relative to the center wall 334. The end wall 336, 338 may extend generally perpendicular to the center wall 334.

In an exemplary embodiment, each ground shroud 302 includes an inner shroud 340 and an outer shroud 342. The outer shroud 342 is located forward of the inner shroud 340. A shroud transition 344 is provided between the inner shroud 340 and the outer shroud 342. The shroud transition 344 varies a depth of the shroud cavity 332 along a length of the ground shroud 302. For example, the inner shroud 340 may have a shallower depth while the outer shroud 342 may have a deeper depth. The depth of the shroud cavity 332 may be defined by the width of the end walls 336, 338. In an exemplary embodiment, the shroud transition 344 is defined by the center wall 334. For example, the shroud transition 344 transitions the center wall 334 of the outer shroud 342 outward relative to the center wall 334 of the inner shroud 340. In various embodiments, the center wall 334 of the inner shroud 340 is coplanar with the main body 300 while the center wall 334 of the outer shroud 342 is non-coplanar with the center wall 334 of the inner shroud 340 and the main body 300. In an exemplary embodiment, the first end wall 336 includes a gap 346 along the first end wall 336 between the inner shroud 340 and the outer shroud 342 and the second end wall 338 includes a gap 348 along the second end wall 338 between the inner shroud 340 and the outer shroud 342. The gaps 346, 348 allow the ground shroud 302 to transition between the inner shroud 340 and the outer shroud 342. For example, the gaps 346, 348 are aligned with the shroud transition 344 to allow the center wall 334 to transition during a forming process and to allow the inner and outer shroud portions of the end walls 336, 338 to be bent relative to the center wall 334 during the forming process.

In an exemplary embodiment, the first end wall 336 along the inner shroud 340 has a different width than the first end wall 336 along the outer shroud 342. For example, the first end wall 336 along the outer shroud 342 may be wider such that the distal edges of the first end wall 336 along the inner shroud 340 and the outer shroud 342 are aligned. Similarly, the second end wall 338 along the inner shroud 340 has a different width than the second end wall 338 along the outer shroud 342. For example, the second end wall 338 along the outer shroud 342 may be wider such that distal edges of the second end wall 338 along the inner shroud 340 and the outer shroud 342 are aligned.

In an exemplary embodiment, the ground shroud 302 includes engagement fingers 350 configured to engage the shield structure of the receptacle assembly 104 (shown in FIG. 1) to electrically connect the first mating ground shield 202 with the receptacle assembly 104. The engagement fingers 350 may be deflectable spring beams in various embodiments. Alternatively, the engagement fingers 350 may be bumps or protrusions configured to engage the shield structure of the receptacle assembly 104. In an exemplary embodiment, the ground shroud 302 includes engagement bumps 352 along the shroud walls 330 configured to engage part of the shield structure 126 of the header assembly 102. For example, the engagement bumps 352 may engage a conductive portion of the header housing 120 (shown in FIG. 1). In the illustrated embodiment, the engagement bumps 352 are provided along the end walls 336, 338. Optionally, the engagement bumps 352 may be provided along both the inner shroud 340 and the outer shroud 342 to provide multiple points of contact with the shield structure.

In an exemplary embodiment, the ground shroud 302 includes connecting tabs 360 configured to electrically connect the first mating ground shield 202 with the connecting ground shield 206 (shown in FIG. 2). The connecting tabs 360 may be protrusions or fingers extending from the ground shroud 302. In the illustrated embodiment, the connecting tabs 360 extend from the end walls 336, 338, such as from the inner shroud 340. The connecting tabs 360 may be provided at other locations in alternative embodiments.

Figure 6:
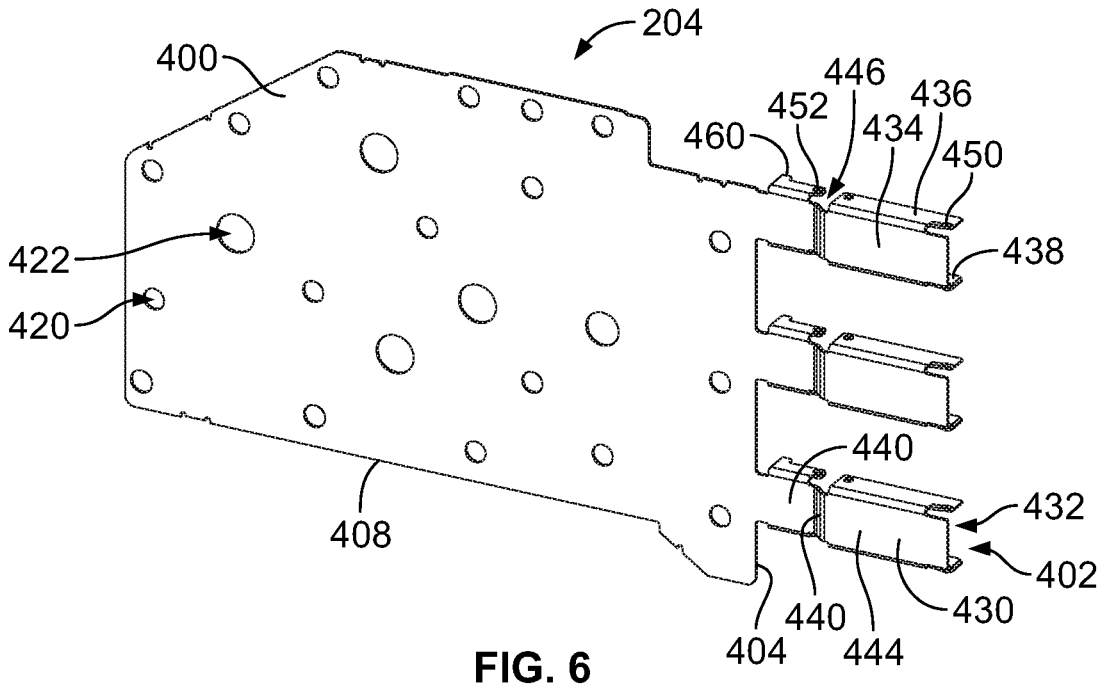
FIG. 6 is a perspective view of a second mating ground shield of the contact module in accordance with an exemplary embodiment.
Figure 7:
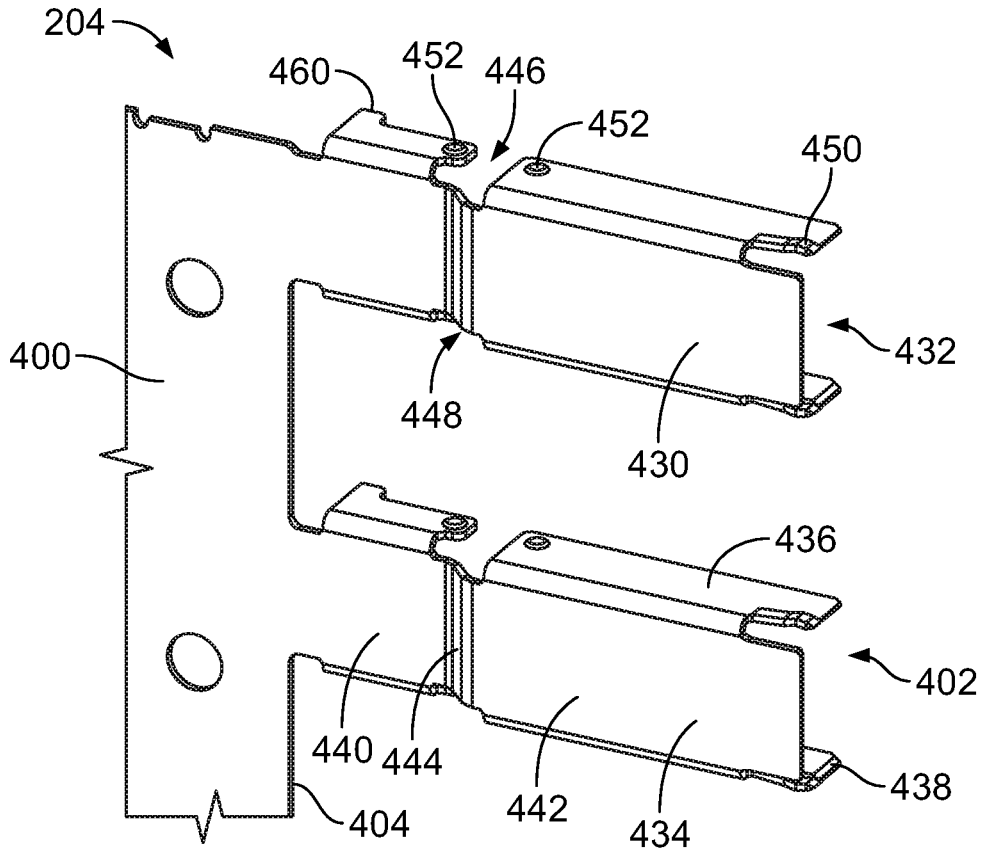
FIG. 7 is an enlarged perspective view of a portion of the second mating ground shield in accordance with an exemplary embodiment.

FIG. 6 is a perspective view of the second mating ground shield 204 in accordance with an exemplary embodiment. FIG. 7 is an enlarged perspective view of a portion of the second mating ground shield 204 in accordance with an exemplary embodiment. The second mating ground shield 204 is similar to the first mating ground shield 202 and is configured to be coupled to the first mating ground shield 202 when the contact module 122 is assembled. The second mating ground shield 204 includes a main body 400. In the illustrated embodiment, the main body 400 is generally planar. In an exemplary embodiment, the second mating ground shield 204 is manufactured from a metal material. For example, the metal material may be phosphor-bronze, brass, copper, silver, aluminum, platinum and the like or a combination thereof. In an exemplary embodiment, the second mating ground shield 204 may be stamped and formed.

The second mating ground shield 204 includes ground shrouds 402 extending forward from a front 404 of the main body 400. The positions of the ground shrouds 402 are offset and shifted relative to the positions of the ground shrouds 302 to allow the ground shrouds 402 to be interspersed with the ground shrouds 302 when the first and second mating ground shields 202, 204 are coupled together. The ground shrouds 402 are configured to provide electrical shielding for the mating portions 250 (shown in FIG. 3) of the signal contacts 124 (shown in FIG. 3). In the illustrated embodiment, the second mating ground shield 204 does not include ground pins extending from a bottom 408 of the second mating ground shield 204. In alternative embodiments, the second mating ground shield 204 may include ground pins configured to be terminated to the circuit board 106 (shown in FIG. 1).

In an exemplary embodiment, the second mating ground shield 204 includes securing post openings 420 configured to receive corresponding securing posts 290 at the first side 270 of the dielectric frame 240 (shown in FIG. 3). The securing posts 290 extend through the securing post openings 420 and are configured to be secured to the second mating ground shield 204. Optionally, the securing posts 290 may be heat staked or riveted to the second mating ground shield 204 to secure the second mating ground shield 204 to the dielectric frame 240. In various embodiments, the securing posts 290 may be coupled to the second mating ground shield 204 by ultrasonic welding. In an exemplary embodiment, the second mating ground shield 204 includes locating post openings 422 configured to receive corresponding locating posts 292 (shown in FIG. 3).

The ground shrouds 402 extend forward from the front edge of the main body 400 at the front 404. Each ground shroud 402 includes shroud walls 430 forming a shroud cavity 432. The shroud cavity 432 is sized and shaped to receive the corresponding mating portion extension 242 (shown in FIG. 3) and the mating portions 250 of the signal contacts 124. The shroud walls 430 provide electrical shielding for the mating portions 250 in the shroud cavity 432.

In an exemplary embodiment, the shroud walls 430 form a C-shaped ground shroud 402. The ground shroud 402 may have other shapes in alternative embodiments. In the illustrated embodiment, the shroud walls 430 include a center wall 434, a first end wall 436, and a second end wall 438. The first end wall 436 extends from the top edge of the center wall 434 and the second end wall 438 extends from the bottom edge of the center wall 434. In various embodiments, the first end wall 436 may extend generally parallel to the second end wall 438. In an exemplary embodiment, the first and second end walls 436, 438 are formed by folding or bending the end wall 436, 438 relative to the center wall 434. The end wall 436, 438 may extend generally perpendicular to the center wall 434.

In an exemplary embodiment, each ground shroud 402 includes an inner shroud 440 and an outer shroud 442. The outer shroud 442 is located forward of the inner shroud 440. A shroud transition 444 is provided between the inner shroud 440 and the outer shroud 442. The shroud transition 444 varies a depth of the shroud cavity 432 along a length of the ground shroud 402. For example, the inner shroud 440 may have a shallower depth while the outer shroud 442 may have a deeper depth. The depth of the shroud cavity 432 may be defined by the width of the end walls 436, 438. In an exemplary embodiment, the shroud transition 444 is defined by the center wall 434. For example, the shroud transition 444 transitions the center wall 434 of the outer shroud 442 outward relative to the center wall 434 of the inner shroud 440. In various embodiments, the center wall 434 of the inner shroud 440 is co-planer with the main body 400 while the center wall 434 of the outer shroud 442 is non-coplanar with the center wall 434 of the inner shroud 440 and the main body 400. In an exemplary embodiment, the first end wall 436 includes a gap 446 along the first end wall 436 between the inner shroud 440 and the outer shroud 442 and the second end wall 438 includes a gap 448 along the second end wall 438 between the inner shroud 440 and the outer shroud 442. The gaps 446, 448 allow the ground shroud 402 to transition between the inner shroud 440 and the outer shroud 442. For example, the gaps 446, 448 are aligned with the shroud transition 444 to allow the center wall 434 to transition during a forming process and to allow the inner and outer shroud portions of the end walls 436, 438 to be bent relative to the center wall 434 during the forming process.

In an exemplary embodiment, the first end wall 436 along the inner shroud 440 has a different width than the first end wall 436 along the outer shroud 442. For example, the first end wall 436 along the outer shroud 442 may be wider such that the distal edges of the first end wall 436 along the inner shroud 440 and the outer shroud 442 are aligned. Similarly, the second end wall 438 along the inner shroud 440 has a different width than the second end wall 438 along the outer shroud 442. For example, the second end wall 438 along the outer shroud 442 may be wider such that distal edges of the second end wall 438 along the inner shroud 440 and the outer shroud 442 are aligned.

In an exemplary embodiment, the ground shroud 402 includes engagement fingers 450 configured to engage the shield structure of the receptacle assembly 104 (shown in FIG. 1) to electrically connect the second mating ground shield 204 with the receptacle assembly 104. The engagement fingers 450 may be deflectable spring beams in various embodiments. Alternatively, the engagement fingers 450 may be bumps or protrusions configured to engage the shield structure of the receptacle assembly 104. In an exemplary embodiment, the ground shroud 402 includes engagement bumps 452 along the shroud walls 430 configured to engage part of the shield structure 126 of the header assembly 102. For example, the engagement bumps 452 may engage a conductive portion of the header housing 120 (shown in FIG. 1). In the illustrated embodiment, the engagement bumps 452 are provided along the end walls 436, 438. Optionally, the engagement bumps 452 may be provided along both the inner shroud 440 and the outer shroud 442 to provide multiple points of contact with the shield structure.

In an exemplary embodiment, the ground shroud 402 includes connecting tabs 460 configured to electrically connect the second mating ground shield 204 with the connecting ground shield 206 (shown in FIG. 2). The connecting tabs 460 may be protrusions or fingers extending from the ground shroud 402. In the illustrated embodiment, the connecting tabs 460 extend from the end walls 436, 438, such as from the inner shroud 440. The connecting tabs 460 may be provided at other locations in alternative embodiments.

Figure 8:
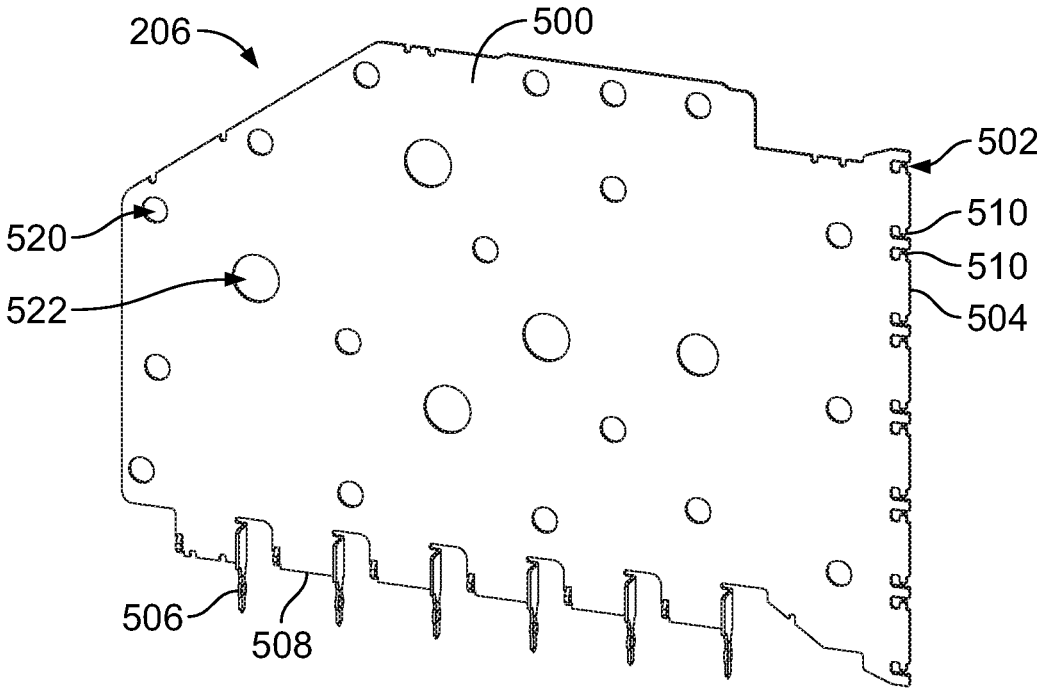
FIG. 8 is a perspective view of a connecting ground shield of the contact module in accordance with an exemplary embodiment.
Figure 9:
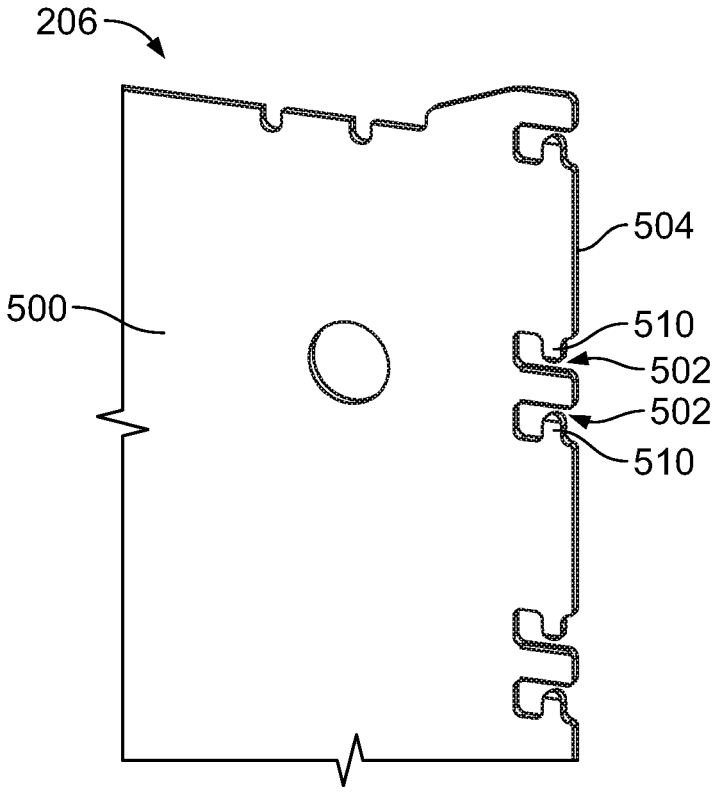
FIG. 9 is an enlarged perspective view of a portion of the connecting ground shield in accordance with an exemplary embodiment.

FIG. 8 is a perspective view of the connecting ground shield 206 in accordance with an exemplary embodiment. FIG. 9 is an enlarged perspective view of a portion of the connecting ground shield 206 in accordance with an exemplary embodiment. The connecting ground shield 206 includes a main body 500. In the illustrated embodiment, the main body 500 is generally planar. In an exemplary embodiment, the connecting ground shield 206 is manufactured from a metal material. For example, the metal material may be phosphor-bronze, brass, copper, silver, aluminum, platinum and the like or a combination thereof. In an exemplary embodiment, the connecting ground shield 206 may be stamped and formed.

The connecting ground shield 206 includes pockets 502 at a front 504 of the main body 500. The pockets 502 are configured to receive the connecting tabs 360, 460 of the first and second mating ground shields 202, 204 to electrically connect the connecting ground shield 206 with the first and second mating ground shields 202, 204. In an exemplary embodiment, the connecting ground shield 206 includes connecting fingers 510 extending into the pockets 502. The connecting fingers 510 are configured to engage the connecting tabs 360, 460 to create an electrical connection between the connecting ground shield 206 and the first and second mating ground shields 202, 204.

The connecting ground shield 206 includes a plurality of ground pins 506 extending from a bottom 508 of the connecting ground shield 206. The ground pins 506 are configured to be terminated to the circuit board 106 (shown in FIG. 1). The ground pins 506 may be compliant pins, such as eye-of-the-needle pins, that are press-fit into plated vias in the circuit board 106. Other types of termination means or features may be provided in alternative embodiments to couple the connecting ground shield 206 to the circuit board 106.

In an exemplary embodiment, the connecting ground shield 206 includes securing post openings 520 configured to receive corresponding securing posts 290 at the second side 272 of the dielectric frame 240 (shown in FIG. 5). The securing posts 290 extend through the securing post openings 520 and are configured to be secured to the connecting ground shield 206. Optionally, the securing posts 290 may be heat staked or riveted to the connecting ground shield 206 to secure the connecting ground shield 206 to the dielectric frame 240. In various embodiments, the securing posts 290 may be coupled to the connecting ground shield 206 by ultrasonic welding. In an exemplary embodiment, the connecting ground shield 206 includes locating post openings 522 configured to receive corresponding locating posts 292 (shown in FIG. 5).

Figure 10:
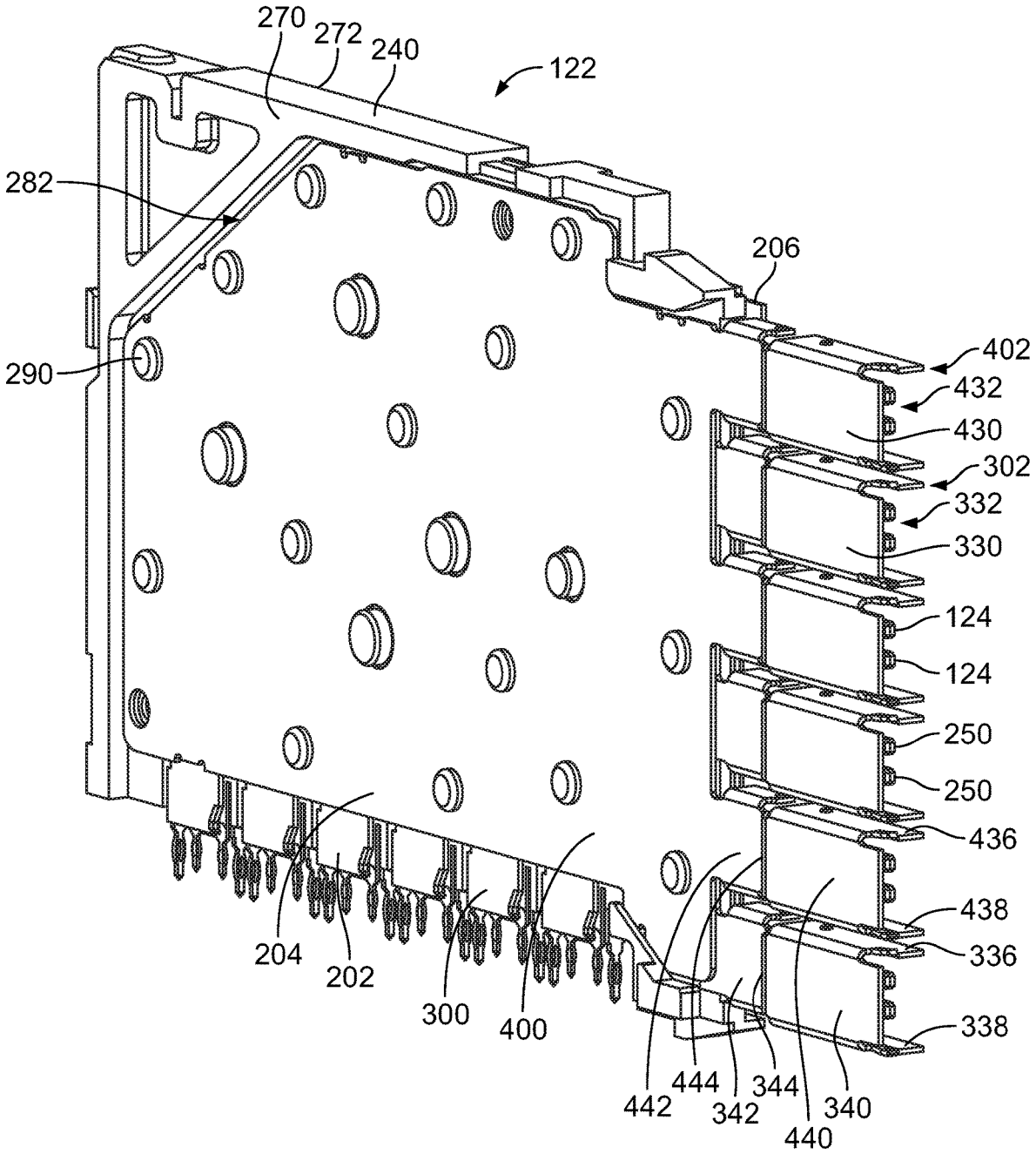
FIG. 10 is a perspective view of a first side of the contact module in accordance with an exemplary embodiment.
Figure 11:
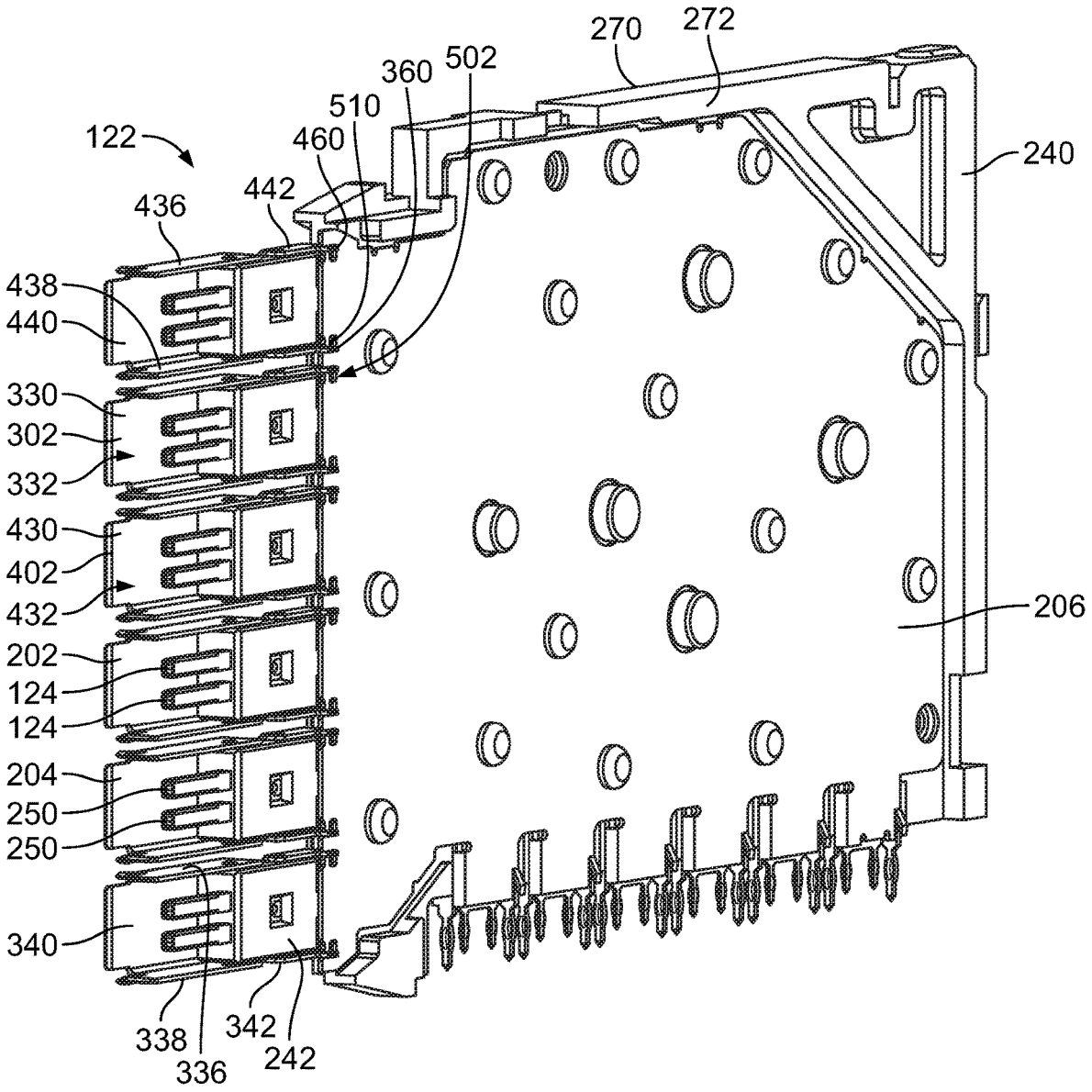
FIG. 11 is a perspective view of a second side of the contact module in accordance with an exemplary embodiment.
Figure 12:
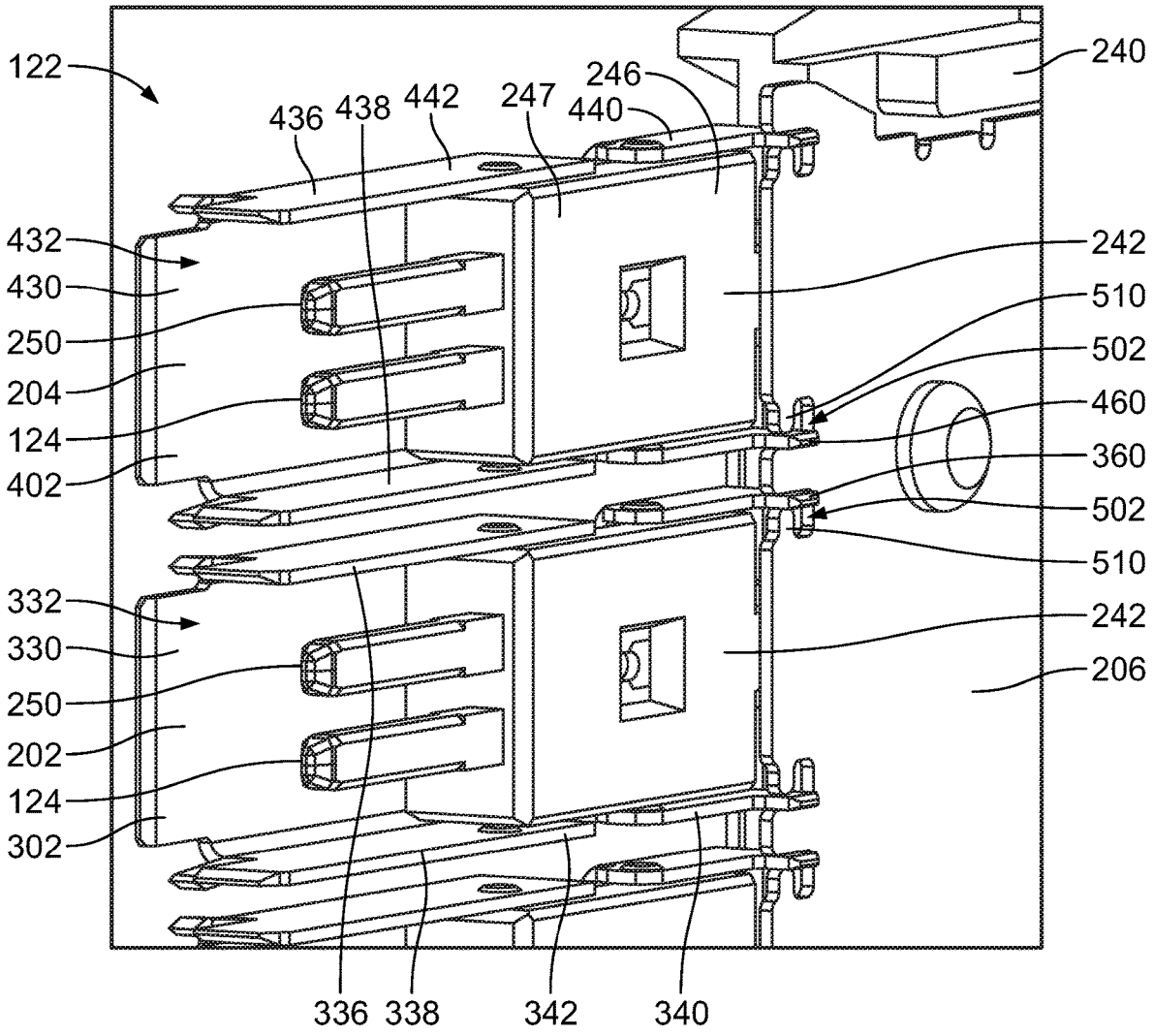
FIG. 12 is an enlarged perspective view of a portion of the second side of the contact module in accordance with an exemplary embodiment.

FIG. 10 is a perspective view of the first side of the contact module 122 in accordance with an exemplary embodiment. FIG. 11 is a perspective view of the second side of the contact module 122 in accordance with an exemplary embodiment. FIG. 12 is an enlarged perspective view of a portion of the second side of the contact module 122 in accordance with an exemplary embodiment. When assembled, the first and second mating ground shields 202, 204 are coupled to the first side 270 of the dielectric frame 240 and the connecting ground shield 206 is coupled to the second side 272 of the dielectric frame 240. The securing posts 290 are used to secure the ground shields 202, 204, 206 to the dielectric frame 240. The first and second mating ground shields 202, 204 are electrically connected to the connecting ground shield 206 by the connecting tabs 360, 460. For example, the connecting tabs 360, 460 are received in the pockets 502 and the connecting fingers 510 engage the connecting tabs 360, 460 to hold the connecting tabs 360, 460 and the pockets 502 by an interference fit. Other types of mechanical and electrical connections may be provided between the ground shields 202, 204, 206 in alternate embodiments.

In an exemplary embodiment, both the first and second mating ground shields 202, 204 are received in the first pocket 282 at the first side 270. An inside of the main body 400 of the second mating ground shield 204 is held against an outside of the main body 300 of the first mating ground shield 202. The first and second mating ground shields 202, 204 are electrically connected together by the direct contact between the main bodies 300, 400. In an exemplary embodiment, the ground shrouds 302, 402 are offset relative to each other such that the ground shrouds 302, 402 are interspersed at the front of the contact module 122. The shroud cavities 332, 432 receive the mating portion extensions 242 and the mating portions 250 of the signal contacts 124. The shroud walls 330, 430 extend along the surfaces of the mating portion extensions 242. In an exemplary embodiment, the shroud transitions 344, 444 of the ground shrouds 302, 402 extend along the corresponding transition ramps 248 (shown in FIG. 3) of the mating portion extensions 242. The inner shrouds 340, 440 of the ground shrouds 302, 402 extend along the corresponding inner extensions 246 of the mating portion extensions 242 and the outer shrouds 342, 442 of the ground shrouds 302, 402 extend along the corresponding outer extensions 247 of the mating portion extensions 242. The first end walls 336, 436 extend along the upper surfaces of the corresponding mating portion extensions 242 and the second end walls 338, 438 extend along the lower surfaces of the corresponding mating portion extensions 242.

Figure 13:
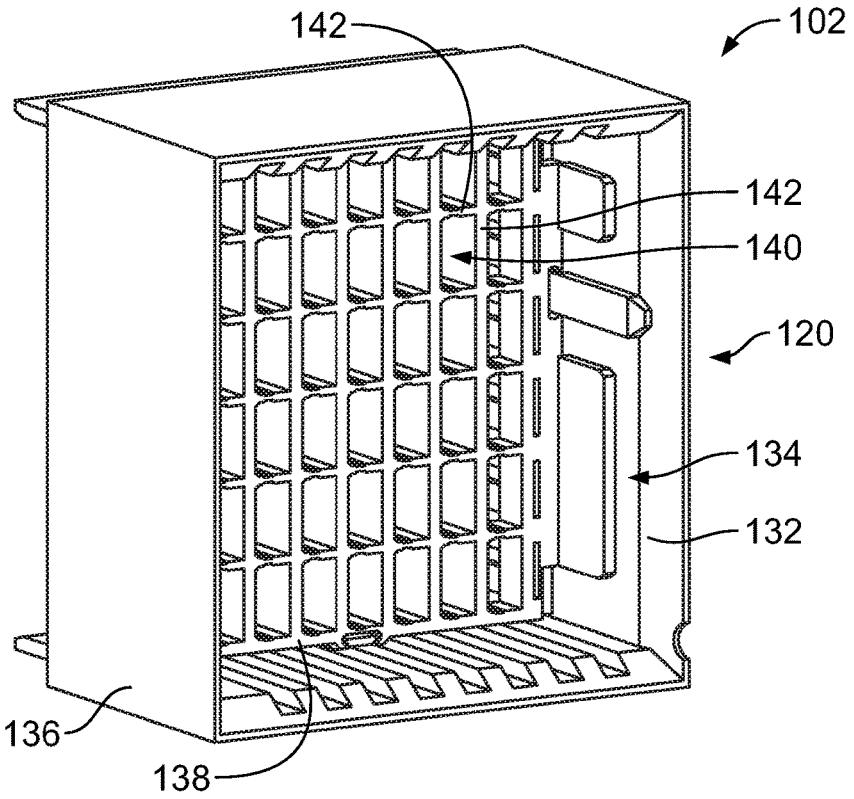
FIG. 13 is a front perspective view of the header housing in accordance with an exemplary embodiment.
Figure 14:
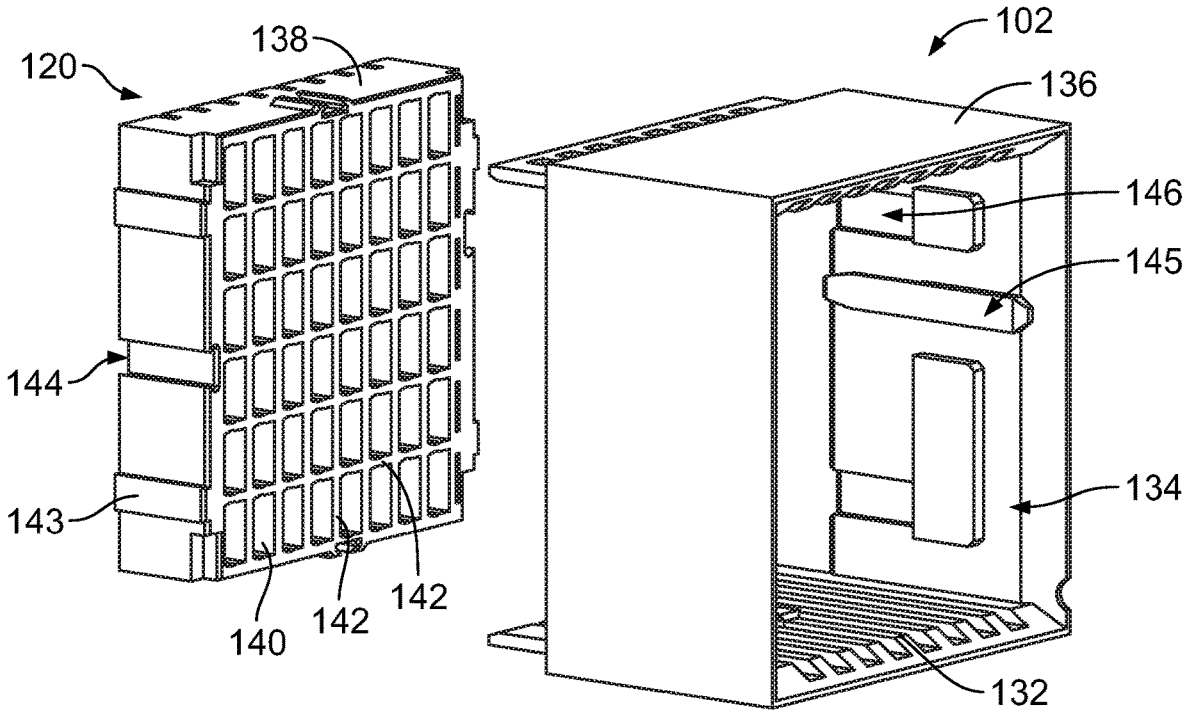
FIG. 14 is an exploded view of the header housing in accordance with an exemplary embodiment.
Figure 15:
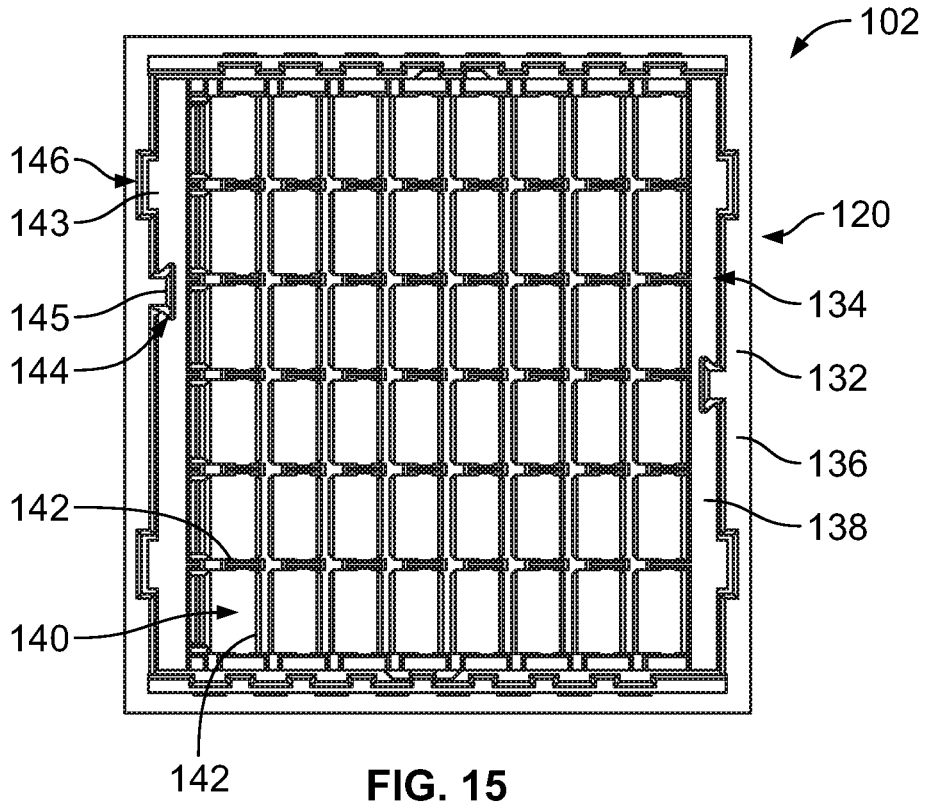
FIG. 15 is a front view of the header housing in an assembled state in an exemplary embodiment.

FIG. 13 is a front perspective view of the header housing 120 in accordance with an exemplary embodiment. FIG. 14 is an exploded view of the header housing 120 in accordance with an exemplary embodiment. FIG. 15 is a front view of the header housing 120 in an assembled state. In an exemplary embodiment, the header housing 120 is a multipiece housing including a front housing 136 and a conductive insert 138 received in the front housing 136. The conductive insert 138 may be secured in the front housing 136 using the contact modules 122 or by other means, such as using adhesive, clips, latches or other securing elements. The front housing 136 includes the walls 132 forming the header chamber 134. The conductive insert 138 is received in the header chamber 134, such as at a rear of the front housing 136. The front of the front housing 136 is open to receive the receptacle assembly 104 (shown in FIG. 1). In alternative embodiments, the header housing 120 may be a single piece housing having selective shielding, such as plating in select locations to provide shielding and electrical grounding through the header housing 120.

The conductive insert 138 is electrically conductive. The conductive insert 138 forms part of the shield structure of the header assembly 102. The conductive insert 138 is configured to be electrically connected to the ground shrouds 302, 402 (shown in FIG. 10) of the ground shields 202, 204. In an exemplary embodiment, the conductive insert 138 includes a plurality of channels 140 separated by separating walls 142. Each channel 140 receives a corresponding ground shroud 302 or 402. The ground shrouds 302, 402 engage the separating walls 142 to electrically connect the ground shields 202, 204 to the conductive insert 138.

In an exemplary embodiment, the conductive insert 138 and the front housing 136 include guide features to guide mating of the conductive insert 138 with the front housing 136. For example, the conductive insert 138 includes rails 143 and slots 144 and the front housing 136 includes rails 145 and slots 146. The rails 143 of the conductive insert 138 are received in the slots 146 of the front housing 136. The rails 145 of the front housing 136 are received in the slots 144 of the conductive insert 138. The size and/or shape and/or positioning of the guide features may provide keyed mating of the conductive insert 138 and the front housing 136. In various embodiments, the rails 143, 145 and the slots 144, 146 may be dovetailed for enhanced mechanical connection between the conductive insert 138 and the front housing 136.

Figure 16:
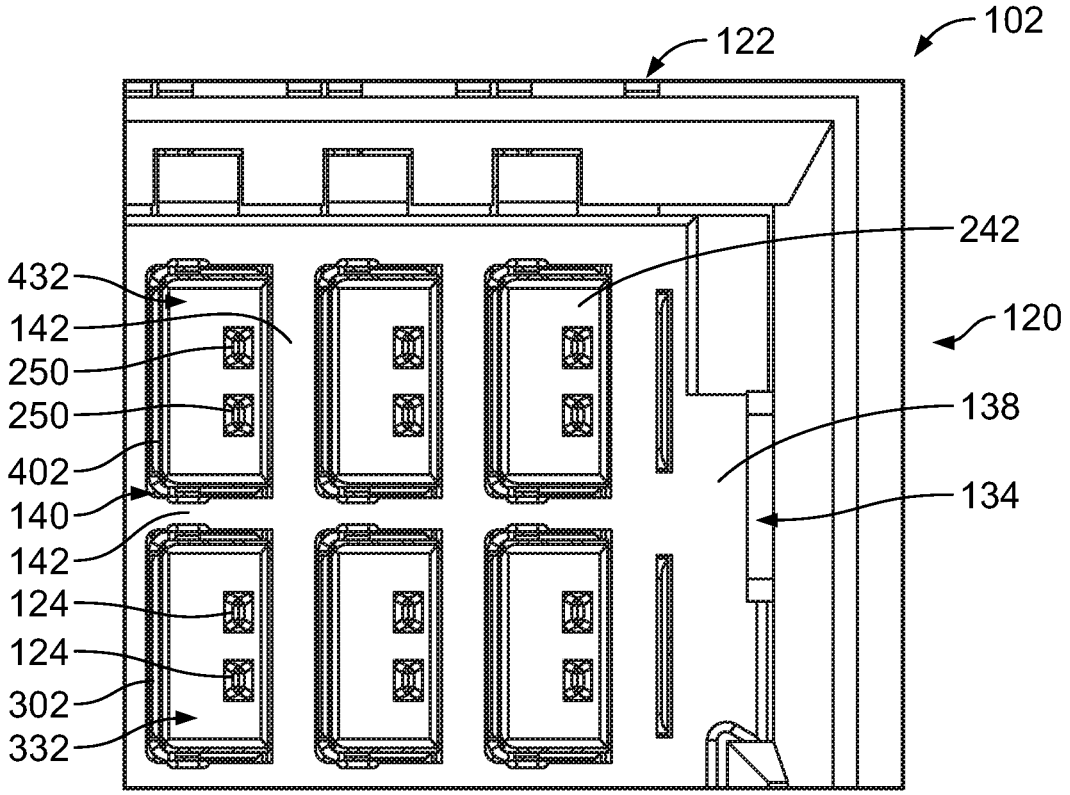
FIG. 16 is a front view of a portion of the header assembly in accordance with an exemplary embodiment.
Figure 17:
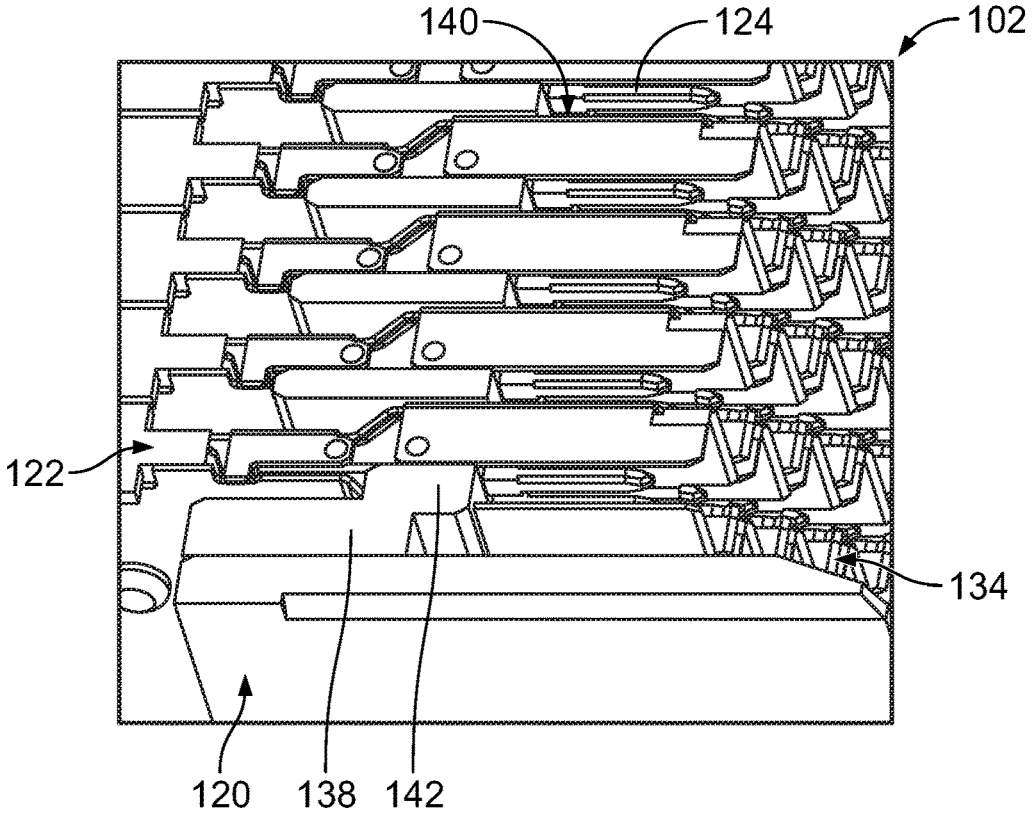
FIG. 17 is a sectional view of a portion of the header assembly in accordance with an exemplary embodiment.
Figure 18:
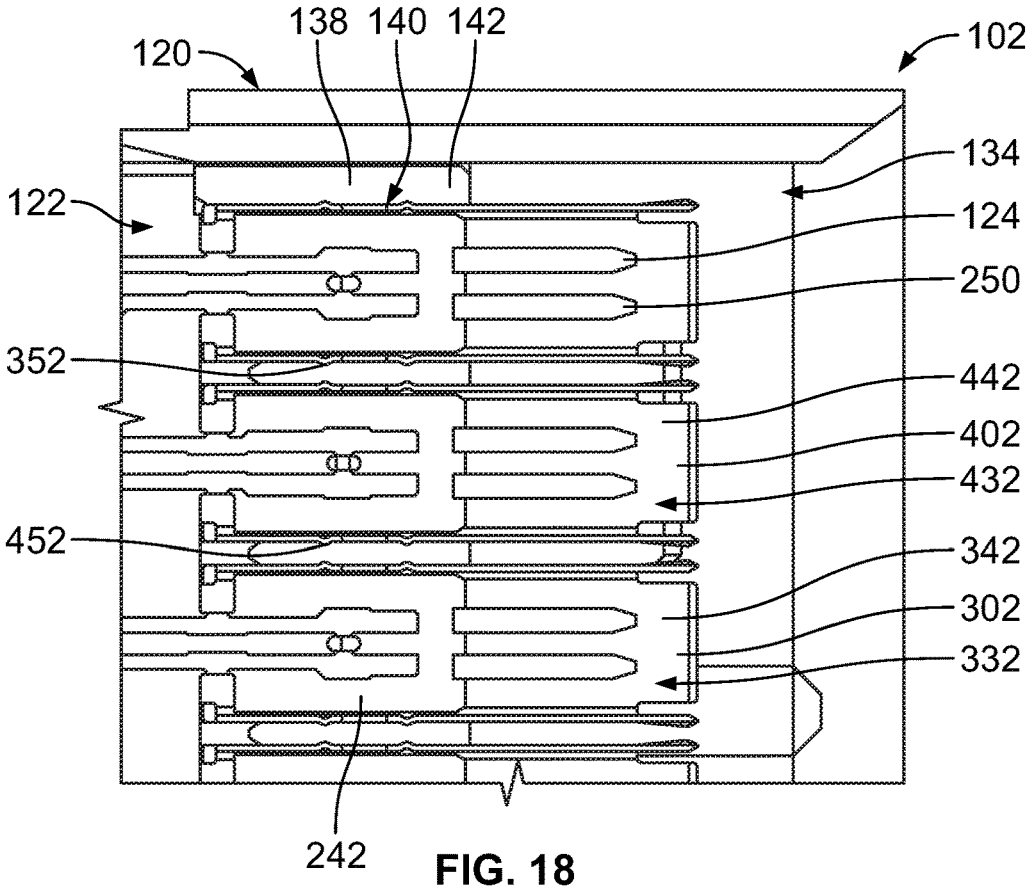
FIG. 18 is a cross-sectional view of a portion of the header assembly in accordance with an exemplary embodiment.

FIG. 16 is a front view of a portion of the header assembly 102 in accordance with an exemplary embodiment. FIG. 17 is a sectional view of a portion of the header assembly 102 in accordance with an exemplary embodiment. FIG. 18 is a cross-sectional view of a portion of the header assembly 102 in accordance with an exemplary embodiment. FIGS. 16-18 illustrate the contact modules 122 loaded in the header housing 120. When assembled, the contact modules 122 are coupled to the conductive insert 138. For example, the ground shrouds 302, 402 are received in corresponding channels 140. The engagement bumps 352, 452 engage the separating walls 142 to mechanically and electrically connect the ground shrouds 302, 402 to the conductive insert 138. Optionally, two sets of the engagement bumps 352, 452 are provided to ground both portions of the end walls 336, 436. In various embodiments, the conductive insert channel 140 may effectively cover the gaps 346, 446 (shown in FIG. 5).

The mating portion extensions 242 are received in the shroud cavities 332, 432 of the ground shrouds 302, 402. The mating portion extensions 240 position the mating portions 250 relative to the ground shrouds 302, 402 in the shroud cavities 332, 432. In an exemplary embodiment, the outer shrouds 342, 442 extend forward of the mating portion extensions 242 and the conductive insert 138 into the header chamber 134 for mating with the receptacle assembly 104. The ends of the mating portions 250 of the signal contacts 124 extend forward of the mating portion extensions 242 into the header chamber 134 for mating with the receptacle assembly 104. The outer shrouds 342, 442 provide electrical shielding around the ends of the mating portions 250.

Figure 19:
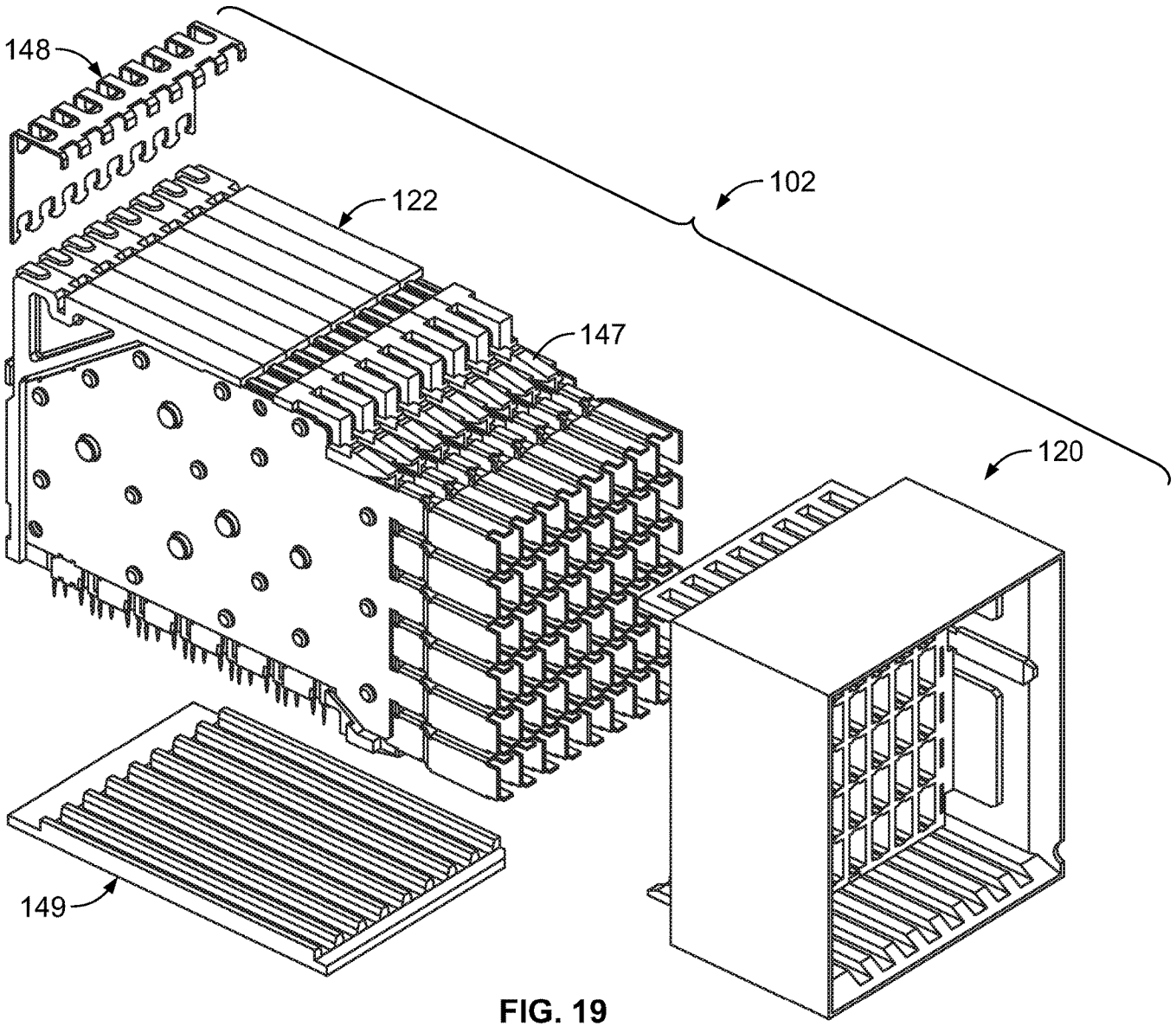
FIG. 19 is an exploded view of the header assembly in accordance with an exemplary embodiment.
Figure 20:
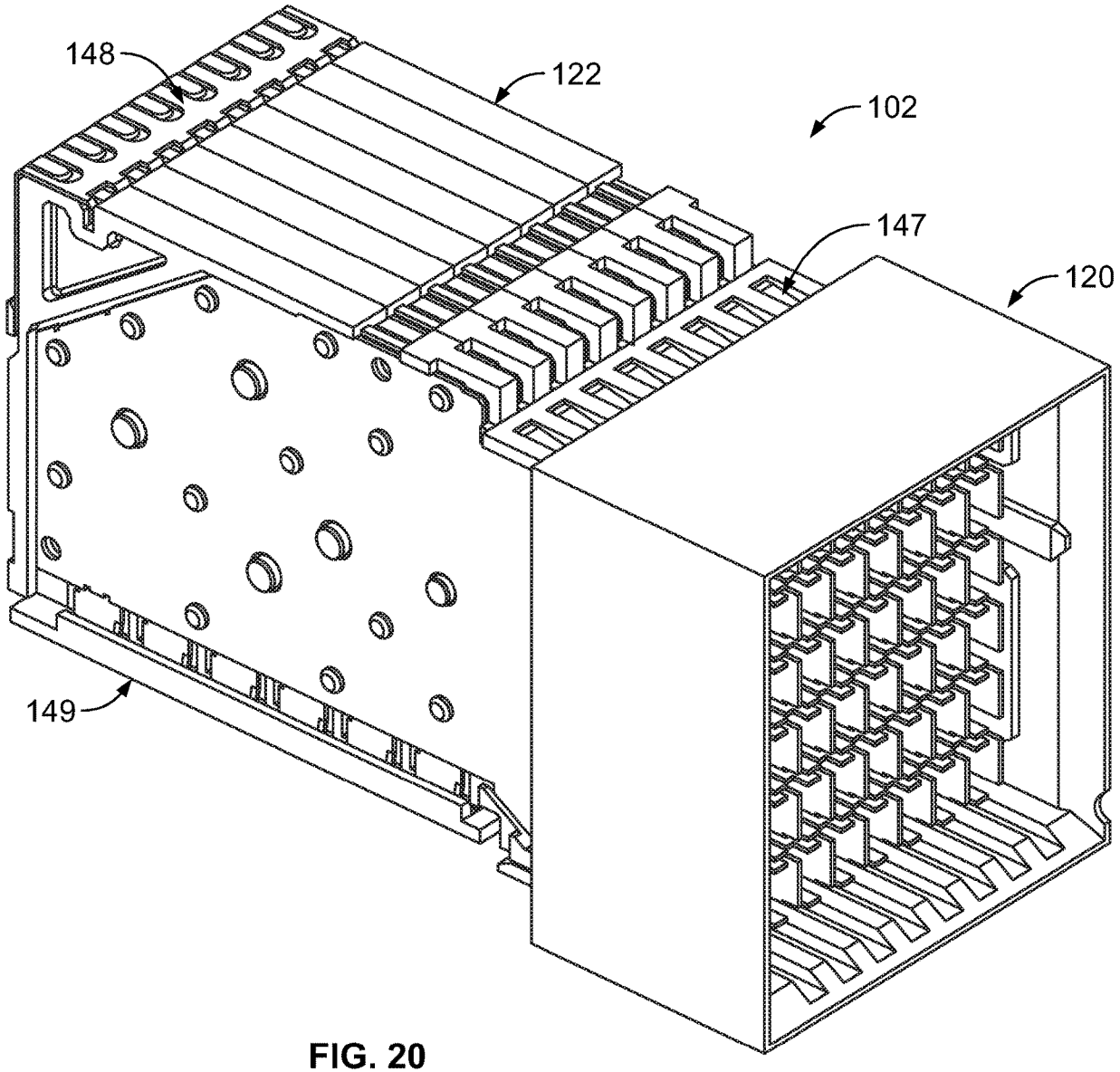
FIG. 20 is an assembled view of the header assembly in accordance with an exemplary embodiment.

FIG. 19 is an exploded view of the header assembly 102 in accordance with an exemplary embodiment. FIG. 20 is an assembled view of the header assembly 102 in accordance with an exemplary embodiment. During assembly, the contact modules 122 are arranged in a contact module stack. The contact modules are loaded into the header housing 120 through the rear of the header housing 120. The contact modules 122 may be individually loaded into the header housing 120 or may be loaded into the header housing 120 as one or more contact module stacks. In an exemplary embodiment, the contact modules 122 include latches 147 at the top and/or the bottom, which are used to latchably secure the contact modules 122 in the header housing 120. In an exemplary embodiment, the header assembly 102 includes a clip 148 coupled to the rear ends of the contact modules 122 to hold the contact modules 122 in the contact module stack. In an exemplary embodiment, the header assembly 102 includes a pin organizer 149 at the bottom of the header assembly 102 to receive the signal pins 252 and the ground pins 306, 506 of the contact modules 122.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A header assembly comprising:

a header housing having a header chamber configured to receive a receptacle assembly; and contact modules coupled to the header housing, each contact module including a frame assembly having a signal leadframe and a dielectric frame holding the signal leadframe, the dielectric frame including mating portion extensions at a front of the dielectric frame, the signal leadframe including mating portions extending forward from the mating portion extensions for mating with the receptacle assembly, each contact module including a ground shield coupled to a first side of the dielectric frame, the ground shield includes ground shrouds at a front of the ground shield providing electrical shielding for the mating portions of the signal leadframe, each ground shroud including shroud walls forming a shroud cavity receiving the corresponding mating portion extension, each ground shroud including a shroud transition to vary a depth of the shroud cavity along a length of the ground shroud.

2. The header assembly of claim 1, wherein the ground shroud includes an inner shroud and an outer shroud, the shroud transition being located between the inner shroud and the outer shroud, the outer shroud being deeper than the inner shroud.

3. The header assembly of claim 1, wherein each ground shroud includes a center wall, a first end wall extending from the center wall, and a second end wall extending from the center wall to form a C-shaped ground shroud, the center wall including the shroud transition.

4. The header assembly of claim 3, wherein the ground shroud includes an inner shroud and an outer shroud, the center wall of the outer shroud being non-coplanar with the center wall of the inner shroud, the shroud transition extending between the center wall of the outer shroud in the center wall of the inner shroud.

5. The header assembly of claim 3, wherein the ground shroud includes an inner shroud and an outer shroud, the first end wall being non-continuous including a first gap between the first end wall of the outer shroud and the first end wall of the inner shroud, the second end wall being noncontinuous including a second gap between the second end wall of the outer shroud and the second end wall of the inner shroud.

6. The header assembly of claim 5, wherein the header housing includes a conductive insert having contact channels, the ground shrouds being received in the contact channels with the conductive insert providing shielding along the first gap and the second gap.

7. The header assembly of claim 3, wherein the ground shroud includes an inner shroud and an outer shroud, the first end wall of the outer shroud having a first width and the first end wall of the inner shroud having a second width, the second end wall of the outer shroud having the first width and the second end wall of the inner shroud having the second width.

8. The header assembly of claim 3, wherein the ground shroud includes an inner shroud and an outer shroud, the inner shroud being positioned a first distance from the signal leadframe and the outer shroud being positioned a second distance from the signal leadframe greater than the first distance.

9. The header assembly of claim 1, wherein each mating portion extension includes an inner extension, and outer extension, and a transition ramp between the inner extension and the outer extension, the inner extension having a first width, the outer extension having a second width wider than the first width, the shroud walls following the mating portion extension along the inner extension, the transition ramp and the outer extension.

10. The header assembly of claim 1, wherein each contact module includes a connecting ground shield coupled to the dielectric frame opposite the ground shield, the ground shrouds including connecting tabs engaging the connecting ground shield to electrically connect the ground shield and the connecting ground shield.

11. The header assembly of claim 10, wherein the shroud walls of each ground shroud includes a center wall, a first end wall extending from the center wall, and a second end wall extending from the center wall, the connecting tabs extending from at least one of the first end wall and the second end wall.

12. The header assembly of claim 10, wherein the connecting ground shield includes pockets receiving the connecting tabs and connecting fingers extending into the pockets to engage the connecting tabs.

13. The header assembly of claim 1, wherein the ground shield is a first ground shield, the contact module further comprising a second ground shield coupled to the first ground shield, the second ground shield including second ground shrouds interspersed with the ground shrouds of the first ground shield.

14. The header assembly of claim 1, wherein the signal leadframe includes a front section and a rear section, the front section having a first thickness, the rear section having a second thickness thinner than the first thickness, the front section including the mating portions.

15. The header assembly of claim 14, wherein the signal leadframe is stamped from a metal sheet having the first thickness, the rear section being milled to the second thickness.

16. A header assembly comprising:

a header housing having a header chamber configured to receive a receptacle assembly; and contact modules coupled to the header housing, each contact module including a frame assembly having a signal leadframe and a dielectric frame holding the signal leadframe, the signal leadframe including signal contacts including mating portions extending forward from the dielectric frame for mating with the receptacle assembly, the signal leadframe having a front section and a rear section, the front section having a first material thickness, the rear section having a second material thickness thinner than the first material thickness, the front section including the mating portions, each contact module including a ground shield coupled to a first side of the dielectric frame, the ground shield includes ground shrouds at a front of the ground shield providing electrical shielding for the mating portions of the signal leadframe.

17. The header assembly of claim 16, wherein the signal leadframe is stamped from a metal sheet having the first material thickness, the rear section being milled to the second material thickness.

18. The header assembly of claim 16, wherein the signal leadframe is stamped from a metal sheet having a first side and a second side, each mating portion having a first mating interface at the first side and a second mating interface at the second side.

19. A header assembly comprising:

a header housing having a header chamber configured to receive a receptacle assembly; and contact modules coupled to the header housing, each contact module including a frame assembly having a signal leadframe and a dielectric frame holding the signal leadframe, the signal leadframe including mating portions extending forward from the dielectric frame for mating with the receptacle assembly, each contact module including a mating ground shield coupled to a first side of the dielectric frame and a connecting ground shield, the mating ground shield includes ground shrouds at a front of the mating ground shield providing electrical shielding for the mating portions of the signal leadframe, each mating ground shroud including shroud walls forming a shroud cavity receiving the corresponding mating portions, the mating ground shroud including connecting tabs engaging the connecting ground shield to electrically connect the mating ground shield and the connecting ground shield.

20. The header assembly of claim 19, wherein the shroud walls of each ground shroud includes a center wall, a first end wall extending from the center wall, and a second end wall extending from the center wall, the connecting tabs extending from at least one of the first end wall and the second end wall.

21. The header assembly of claim 19, wherein the connecting ground shield includes pockets receiving the connecting tabs and connecting fingers extending into the pockets to engage the connecting tabs.

* * * * *